US012016369B2

(12) United States Patent
Mua et al.

(10) Patent No.: US 12,016,369 B2
(45) Date of Patent: Jun. 25, 2024

(54) REGENERATED CELLULOSE SUBSTRATE FOR AEROSOL DELIVERY DEVICE

(71) Applicant: NICOVENTURES TRADING LIMITED, London (GB)

(72) Inventors: John Paul Mua, Advance, NC (US); Luis Monsalud, Kernersville, NC (US); Andries Don Sebastian, Winston Salem, NC (US); Sharon Goodall, Southhampton (GB); Kenneth Allen Beard, Lexington, NC (US)

(73) Assignee: NICOVENTURES TRADING LIMITED, London (GB)

( * ) Notice: Subject to any disclaimer, the term of this patent is extended or adjusted under 35 U.S.C. 154(b) by 1003 days.

(21) Appl. No.: 16/848,526

(22) Filed: Apr. 14, 2020

(65) Prior Publication Data

US 2021/0315255 A1 Oct. 14, 2021

(51) Int. Cl.

| | |
|---|---|
| ***A24B 15/167*** | (2020.01) |
| ***A24B 15/16*** | (2020.01) |
| ***A24D 1/20*** | (2020.01) |
| ***A24D 1/22*** | (2020.01) |
| ***A24F 40/20*** | (2020.01) |
| ***A24F 40/57*** | (2020.01) |

(52) U.S. Cl.

CPC ..... *A24B 15/167* (2016.11); *A24B 15/165* (2013.01); *A24D 1/20* (2020.01); *A24D 1/22* (2020.01); *A24F 40/20* (2020.01); *A24F 40/57* (2020.01)

(58) Field of Classification Search

None

See application file for complete search history.

(56) References Cited

U.S. PATENT DOCUMENTS

| | | | |
|---|---|---|---|
| 3,860,012 | A | 1/1975 | Selke |
| 3,894,544 | A | 7/1975 | Egri |
| 4,079,742 | A | 3/1978 | Rainer et al. |

(Continued)

FOREIGN PATENT DOCUMENTS

| | | | |
|---|---|---|---|
| CN | 104856215 | A | 8/2015 |
| CN | 103750535 | A | 12/2015 |

(Continued)

OTHER PUBLICATIONS

"Modified Cross-Section Viscose Fibre: Galaxy VY—Trilobal Cellulosic Fibre," <htlps://web.archive.org/,veb/20160519070915/http://www.kelheim-fibres.com:80/pdf/TDS_Galaxy_VY_0814.pdf>, p. 1.

*Primary Examiner* — Katherine A Will

(74) *Attorney, Agent, or Firm* — Womble Bond Dickinson (US) LLP

(57) ABSTRACT

The present disclosure provides an aerosol generating component containing a substrate impregnated with one or more aerosol forming materials, the substrate including a cellulosic material substantially free of sulfur compounds, and further including one or more of a tobacco pulp, an aqueous tobacco extract, a filler, and a binder. Further provided is an aerosol delivery device including the aerosol generating component. Such devices utilize electrically generated heat or combustible ignition sources to heat the aerosol forming materials, providing an inhalable substance in the form of an aerosol.

17 Claims, 6 Drawing Sheets

(56) References Cited

U.S. PATENT DOCUMENTS 4,646,764 A 3/1987 Young et al.
4,674,519 A 3/1987 Keritsis et al.
4,793,365 A 12/1988 Sensabaugh et al.
4,807,809 A 2/1989 Pryor et al.
4,848,374 A 7/1989 Chard et al.
4,924,887 A 5/1990 Raker et al.
4,928,714 A * 5/1990 Shannon ..... A24D 1/22 131/273
4,947,874 A 8/1990 Brooks et al.
5,025,814 A 6/1991 Raker et al.
5,042,509 A 8/1991 Banerjee et al.
5,101,839 A 4/1992 Jakob et al.
5,105,831 A 4/1992 Banerjee et al.
5,159,942 A 11/1992 Brinkley et al.
5,203,355 A 4/1993 Clearman et al.
5,369,723 A 11/1994 Counts et al.
5,396,911 A 3/1995 Casey, III et al.
5,501,237 A 3/1996 Young et al.
5,598,868 A 2/1997 Jakob et al.
5,666,977 A 9/1997 Higgins et al.
5,724,998 A 3/1998 Gellatly et al.
5,819,751 A 10/1998 Barnes et al.
6,040,560 A * 3/2000 Fleischhauer ..... A61M 11/04 219/494
7,032,601 B2 4/2006 Atchley et al.
7,428,905 B2 9/2008 Mua
7,647,932 B2 1/2010 Cantrell et al.
7,950,399 B2 5/2011 Winterson et al.
7,980,251 B2 7/2011 Winterson et al.
8,079,371 B2 12/2011 Robinson et al.
8,124,147 B2 2/2012 Cheng et al.
8,336,557 B2 12/2012 Kumar et al.
8,402,976 B2 3/2013 Fernando et al.
8,469,036 B2 6/2013 Williams et al.
8,469,037 B2 6/2013 Liu et al.
8,528,569 B1 9/2013 Newton
8,529,914 B2 9/2013 Fuisz et al.
8,613,285 B2 12/2013 Fuisz
8,627,828 B2 1/2014 Strickland et al.
8,747,562 B2 6/2014 Mishra et al.
8,846,075 B2 9/2014 Jonsson et al.
8,863,755 B2 10/2014 Zhuang et al.
8,978,661 B2 3/2015 Atchley et al.
8,992,974 B2 3/2015 McCarty
9,044,049 B2 6/2015 Winterson et al.
9,066,540 B2 6/2015 Atchley et al.
9,078,473 B2 7/2015 Worm et al.
9,149,072 B2 10/2015 Conner et al.
9,161,567 B2 10/2015 Shikata et al.
9,161,908 B2 10/2015 Nilsson
9,167,835 B2 10/2015 Sengupta et al.
9,185,931 B2 11/2015 Gao et al.
9,237,768 B2 1/2016 Carroll et al.
9,345,268 B2 5/2016 Stone et al.
9,358,296 B2 6/2016 McCarty
9,402,414 B2 8/2016 Griscik et al.
9,414,624 B2 8/2016 Carroll et al.
9,462,827 B2 10/2016 Carroll et al.
9,468,233 B2 10/2016 Macko et al.
9,521,864 B2 12/2016 Gao et al.
9,693,582 B2 7/2017 Carroll et al.
9,788,571 B2 10/2017 Conner et al.
9,848,634 B2 12/2017 Fuisz
9,854,830 B2 1/2018 Gao et al.
9,854,831 B2 1/2018 Gao et al.
9,884,015 B2 2/2018 Gao et al.
9,925,145 B2 3/2018 Hübinette et al.
9,930,909 B2 4/2018 Gao et al.
9,974,334 B2 5/2018 Dooly et al.
9,986,756 B2 6/2018 Gao et al.
9,999,243 B2 6/2018 Gao et al.
10,039,309 B2 8/2018 Carroll et al.
10,104,912 B2 10/2018 Sur
10,105,320 B2 10/2018 Gao et al.
10,130,120 B2 11/2018 Mishra et al.
10,172,810 B2 1/2019 McCarty
10,244,786 B2 4/2019 Gao et al.
10,292,431 B2 5/2019 White
10,315,889 B2 6/2019 Kreischer et al.
10,321,707 B2 6/2019 Klipfel et al.
10,327,473 B2 6/2019 Mironov
10,334,873 B2 7/2019 Mishra et al.
10,405,572 B2 9/2019 Batista
10,412,989 B2 9/2019 Klipfel et al.
10,420,365 B2 9/2019 Klipfel et al.
10,440,995 B2 10/2019 Sebastian et al.
10,609,949 B2 4/2020 Hodin et al.
10,647,459 B2 5/2020 Persson
10,750,773 B2 8/2020 Yang et al.
10,791,756 B2 10/2020 Zuchuat et al.
10,798,969 B2 10/2020 Hejazi et al.
2004/0129280 A1 7/2004 Woodson et al.
2004/0226568 A1 11/2004 Takeuchi et al.
2006/0021626 A1* 2/2006 Mua ..... A24B 3/14 131/365
2008/0017203 A1 1/2008 Fagg et al.
2013/0251779 A1 9/2013 Svandal et al.
2014/0162345 A1* 6/2014 Eyal ..... C08L 97/02 127/29
2014/0305448 A1 10/2014 Zuber et al.
2015/0096573 A1 4/2015 Gao et al.
2015/0096574 A1 4/2015 Gao et al.
2015/0096576 A1 4/2015 Gao et al.
2015/0150302 A1 6/2015 Metrangolo et al.
2015/0157052 A1 6/2015 Ademe et al.
2015/0313283 A1 11/2015 Collett et al.
2017/0055576 A1 3/2017 Beeson et al.
2017/0065000 A1 3/2017 Sears et al.
2017/0071250 A1 3/2017 Mironov et al.
2017/0280764 A1 10/2017 Sahlén et al.
2017/0318858 A1 11/2017 Hodin et al.
2018/0140007 A1 5/2018 Aspgren et al.
2018/0153211 A1 6/2018 Persson
2018/0237273 A1 8/2018 Kreischer et al.
2018/0255826 A1 9/2018 Persson et al.
2019/0255035 A1 8/2019 Bruun
2019/0291900 A1 9/2019 Persson et al.
2020/0093182 A1 3/2020 Monsalud et al.
2020/0154784 A1 5/2020 Sebastian et al.
2020/0253269 A1* 8/2020 Rousseau ..... A24B 15/16
2020/0281249 A1 9/2020 Sebastian et al.
2020/0384221 A1* 12/2020 Lang ..... A24B 15/167

FOREIGN PATENT DOCUMENTS

CN 105747266 A 7/2016
CN 105919152 A 9/2016
CN 106235376 A 12/2016
CN 107616540 A 1/2018
CN 107616541 A 1/2018
CN 105768191 A 3/2018
CN 107927891 A 4/2018
CN 108143004 A 6/2018
CN 108208917 A 6/2018
CN 108323793 A 7/2018
CN 108451001 A 8/2018
CN 108451054 A 8/2018
CN 108497544 A 9/2018
CN 107259632 A 10/2018
CN 107307466 A 10/2018
CN 107319627 A 10/2018
CN 108652067 A 10/2018
CN 109043639 12/2018
CN 106368069 A 2/2019
GB 2534213 A 2/2018
WO WO 1997/032490 9/1997
WO WO 1997/032492 9/1997
WO WO 1999/063844 12/1999
WO WO 2010/113702 10/2010
WO WO 2011/101164 8/2011
WO WO 2012/133289 10/2012
WO WO 2013/178769 12/2013
WO WO 2015/055567 4/2015
WO WO 2015/082652 6/2015

(56) References Cited

FOREIGN PATENT DOCUMENTS

| | | |
|---|---|---|
| WO | WO 2015/176898 | 11/2015 |
| WO | WO 2015/177265 | 11/2015 |
| WO | WO 2016/050471 | 4/2016 |
| WO | WO 2016/156219 | 10/2016 |
| WO | WO 2016/156598 | 10/2016 |
| WO | WO 2016/162446 | 10/2016 |
| WO | WO 2017/041920 | 3/2017 |
| WO | WO 2017/051034 | 3/2017 |
| WO | WO 2017/068091 | 4/2017 |
| WO | WO 2017/068092 | 4/2017 |
| WO | WO 2017/068093 | 4/2017 |
| WO | WO 2017/068099 | 4/2017 |
| WO | WO 2017/077110 | 5/2017 |
| WO | WO 2017/077112 | 5/2017 |
| WO | WO 2017/108912 | 6/2017 |
| WO | WO 2018/033477 | 2/2018 |
| WO | WO 2018/162515 | 3/2018 |
| WO | WO 2018/172389 | 3/2018 |
| WO | WO 2018/122070 | 7/2018 |
| WO | WO 2018/152334 | 8/2018 |
| WO | WO 2018/197454 | 11/2018 |
| WO | WO 2018/215481 | 11/2018 |
| WO | WO 2019/036243 | 2/2019 |
| WO | W0 2019/105960 | 6/2019 |
| WO | WO 2019/115778 | 6/2019 |
| WO | WO 2019/162918 | 8/2019 |
| WO | WO2020/013339 | 1/2020 |

* cited by examiner

REGENERATED CELLULOSE SUBSTRATE FOR AEROSOL DELIVERY DEVICE

FIELD OF THE DISCLOSURE

The present disclosure relates to aerosol generating components, aerosol delivery devices, and aerosol delivery systems, such as smoking articles, that utilize electrically-generated heat or combustible ignition sources to heat aerosol forming materials, preferably without significant combustion, in order to provide an inhalable substance in the form of an aerosol for human consumption.

BACKGROUND

Many smoking articles have been proposed through the years as improvements upon, or alternatives to, smoking products based upon combusting tobacco for use. Some example alternatives have included devices wherein a solid or liquid fuel is combusted to transfer heat to tobacco or wherein a chemical reaction is used to provide such heat source. Additional example alternatives use electrical energy to heat tobacco and/or other aerosol generating substrate materials, such as described in U.S. Pat. No. 9,078,473 to Worm et al., which is incorporated herein by reference in its entirety.

The point of the improvements or alternatives to smoking articles typically has been to provide the sensations associated with cigarette, cigar, or pipe smoking, without delivering considerable quantities of incomplete combustion and pyrolysis products. To this end, there have been proposed numerous smoking products, flavor generators, and medicinal inhalers which utilize electrical energy to vaporize or heat a volatile material, or attempt to provide the sensations of cigarette, cigar, or pipe smoking without burning tobacco to a significant degree. See, for example, the various alternative smoking articles, aerosol delivery devices and heat generating sources set forth in the background art described in U.S. Pat. No. 7,726,320 to Robinson et al.; and U.S. Pat. App. Pub. Nos. 2013/0255702 to Griffith, Jr. et al.; and 2014/0096781 to Sears et al., each of which are incorporated herein by reference in their entireties.

Articles that produce the taste and sensation of smoking by electrically heating tobacco, tobacco-derived materials, or other plant derived materials have suffered from inconsistent performance characteristics. For example, some articles have suffered from inconsistent release of flavors or other inhalable materials, inadequate loading of aerosol forming materials on substrates, or the presence of poor sensory characteristics. Accordingly, it can be desirable to provide a smoking article that can provide the sensations of cigarette, cigar, or pipe smoking, that does so without combusting the substrate material and that does so with advantageous performance characteristics.

BRIEF SUMMARY

The present disclosure relates to aerosol generating components and aerosol delivery devices that utilize electrically-generated heat or combustible ignition sources to heat a substrate carrying one or more aerosol forming materials, in order to provide an inhalable substance in the form of an aerosol for human consumption.

Accordingly, in one aspect, the disclosure provides an aerosol generating component comprising a substrate carrying one or more aerosol forming materials, the substrate comprising a cellulosic material substantially free of sulfur compounds, and further comprising one or more of a tobacco pulp, an aqueous tobacco extract, a filler, and a binder.

In some embodiments, the cellulosic material is a cellulosic pulp or regenerated cellulose comprising at least about 90% cellulose by weight. In some embodiments, the cellulosic pulp is derived from flax, cotton linters, kenaf, hibiscus, hemp, tobacco, or a combination thereof.

In some embodiments, the cellulosic material is a cellulose ether. In some embodiments, the cellulose ether is selected from the group consisting of methylcellulose, hydroxypropylcellulose, hydroxypropylmethylcellulose, hydroxyethyl cellulose, carboxymethylcellulose, and combinations thereof.

In some embodiments, the substrate is substantially free of wood pulp.

In some embodiments, the cellulosic material contains less than about 350 ppm of sulfur compounds, measured as elemental sulfur. In some embodiments, the cellulosic material the cellulosic material contains from about 100 ppm to about 350 ppm of sulfur compounds, measured as elemental sulfur.

In some embodiments, the binder is selected from the group consisting of alginates, starches, gums, dextrans, carrageenan, povidone, pullulan, zein, or combinations thereof.

In some embodiments, the filler is selected from the group consisting of maltodextrin, dextrose, calcium carbonate, calcium phosphate, lactose, sugar alcohols, microcrystalline cellulose, and combinations thereof.

In some embodiments, the one or more aerosol forming materials are selected from the group consisting of water, polyhydric alcohols, polysorbates, sorbitan esters, fatty acids, fatty acid esters, waxes, cannabinoids, terpenes, sugar alcohols, and combinations thereof. In some embodiments, the one or more aerosol forming materials are polyhydric alcohols. In some embodiments, the polyhydric alcohols are selected from the group consisting of glycerol, propylene glycol, 1,3-propanediol, diethylene glycol, triethylene glycol, and combinations thereof.

In some embodiments, the substrate further carries a flavorant, an active ingredient, or a combination thereof. In some embodiments, the active ingredient comprises a nicotine component.

In some embodiments, the substrate is impregnated with the one or more aerosol forming materials at a loading of from about 15 to about 55% by weight, based on a total weight of the impregnated substrate.

In some embodiments, the substrate is in particulate form, shredded form, film form, paper process sheet form, cast sheet form, bead form, granular rod form, or extrudate form. In some embodiments, the substrate is formed into a substantially cylindrical shape.

In another aspect is provided an aerosol delivery device, comprising the aerosol generating component as disclosed herein; a heat source configured to heat the aerosol forming materials carried in the substrate portion to form an aerosol; and an aerosol pathway extending from the aerosol generating component to a mouth-end of the aerosol delivery device.

In some embodiments, the heat source comprises either an electrically powered heating element or a combustible ignition source. In some embodiments, the heat source is a combustible ignition source comprising a carbon-based material. In some embodiments, the heat source is an electrically-powered heating element. In some embodiments, the aerosol delivery device further comprises a power source electronically connected to the heating element. In some embodiments, the aerosol delivery device further comprises a controller configured to control the power transmitted by the power source to the heating element.

The disclosure includes, without limitations, the following embodiments.

Embodiment 1: An aerosol generating component comprising a substrate carrying one or more aerosol forming materials, the substrate comprising a cellulosic material substantially free of sulfur compounds, and further comprising one or more of a tobacco pulp, an aqueous tobacco extract, a filler, and a binder.

Embodiment 2: The aerosol generating component of embodiment 1, wherein the cellulosic material is a cellulosic pulp or regenerated cellulose comprising at least about 90% cellulose by weight.

Embodiment 3: The aerosol generating component of embodiment 1 or 2, wherein the cellulosic pulp is derived from flax, cotton linters, kenaf, hibiscus, hemp, tobacco, or a combination thereof.

Embodiment 4: The aerosol generating component of any one of embodiments 1 to 3, wherein the cellulosic material is a cellulose ether.

Embodiment 5: The aerosol generating component of any one of embodiments 1 to 4, wherein the cellulose ether is selected from the group consisting of methylcellulose, hydroxypropylcellulose, hydroxypropylmethylcellulose, hydroxyethyl cellulose, carboxymethylcellulose, and combinations thereof.

Embodiment 6: The aerosol generating component of any one of embodiments 1 to 5, wherein the substrate is substantially free of wood pulp.

Embodiment 7: The aerosol generating component of any one of embodiments 1 to 6, wherein the cellulosic material contains less than about 350 ppm of sulfur compounds, measured as elemental sulfur.

Embodiment 8: The aerosol generating component of any one of embodiments 1 to 7, wherein the cellulosic material the cellulosic material contains from about 100 ppm to about 350 ppm of sulfur compounds, measured as elemental sulfur.

Embodiment 9: The aerosol generating component of any one of embodiments 1 to 8, wherein the binder is selected from the group consisting of alginates, starches, gums, dextrans, carrageenan, povidone, pullulan, zein, or combinations thereof.

Embodiment 10: The aerosol generating component of any one of embodiments 1 to 9, wherein the filler is selected from the group consisting of maltodextrin, dextrose, calcium carbonate, calcium phosphate, lactose, sugar alcohols, microcrystalline cellulose, and combinations thereof.

Embodiment 11: The aerosol generating component of any one of embodiments 1 to 10, wherein the one or more aerosol forming materials are selected from the group consisting of water, polyhydric alcohols, polysorbates, sorbitan esters, fatty acids, fatty acid esters, waxes, cannabinoids, terpenes, sugar alcohols, and combinations thereof.

Embodiment 12: The aerosol generating component of any one of embodiments 1 to 11, wherein the one or more aerosol forming materials are polyhydric alcohols.

Embodiment 13: The aerosol generating component of any one of embodiments 1 to 12, wherein the polyhydric alcohols are selected from the group consisting of glycerol, propylene glycol, 1,3-propanediol, diethylene glycol, triethylene glycol, and combinations thereof.

Embodiment 14: The aerosol generating component of any one of embodiments 1 to 13, wherein the substrate further carries a flavorant, an active ingredient, or a combination thereof.

Embodiment 15: The aerosol generating component of any one of embodiments 1 to 14, wherein the active ingredient comprises a nicotine component.

Embodiment 16: The aerosol generating component of any one of embodiments 1 to 15, wherein the substrate is impregnated with the one or more aerosol forming materials at a loading of from about 15 to about 55% by weight, based on a total weight of the impregnated substrate.

Embodiment 17: The aerosol generating component of any one of embodiments 1 to 16, wherein, the substrate is in particulate form, shredded form, film form, paper process sheet form, cast sheet form, bead form, granular rod form, or extrudate form.

Embodiment 18: The aerosol generating component of any one of embodiments 1 to 17, wherein the substrate is formed into a substantially cylindrical shape.

Embodiment 19: An aerosol delivery device comprising the aerosol generating component of any one of embodiments 1 to 18; a heat source configured to heat the aerosol forming materials carried in the substrate portion to form an aerosol; and an aerosol pathway extending from the aerosol generating component to a mouth-end of the aerosol delivery device.

Embodiment 20: The aerosol delivery device of embodiment 19, wherein the heat source comprises either an electrically powered heating element or a combustible ignition source.

Embodiment 21: The aerosol delivery device of embodiment 19, wherein the heat source is a combustible ignition source comprising a carbon-based material.

Embodiment 22: The aerosol delivery device of embodiment 19 or 20, wherein the heat source is an electrically-powered heating element.

Embodiment 23: The aerosol delivery device of any one of embodiments 19 to 22, further comprising a power source electronically connected to the heating element.

Embodiment 24: The aerosol delivery device of any one of embodiments 19 to 23, further comprising a controller configured to control the power transmitted by the power source to the heating element.

These and other features, aspects, and advantages of the disclosure will be apparent from a reading of the following detailed description together with the accompanying drawings, which are briefly described below. The invention includes any combination of two, three, four, or more of the above-noted embodiments as well as combinations of any two, three, four, or more features or elements set forth in this disclosure, regardless of whether such features or elements are expressly combined in a specific embodiment description herein. This disclosure is intended to be read holistically such that any separable features or elements of the disclosed invention, in any of its various aspects and embodiments, should be viewed as intended to be combinable unless the context clearly dictates otherwise.

BRIEF DESCRIPTION OF THE DRAWINGS

Having thus described aspects of the disclosure in the foregoing general terms, reference will now be made to the accompanying drawings, which are not necessarily drawn to scale. The drawings are exemplary only, and should not be construed as limiting the disclosure.

Figure 1:
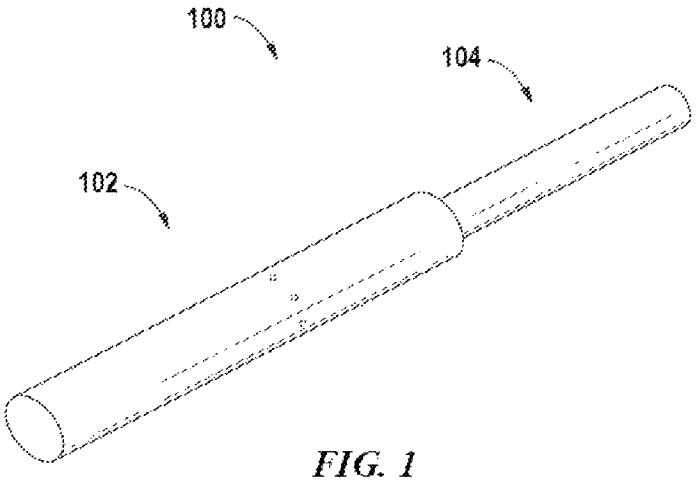
Figure 2:
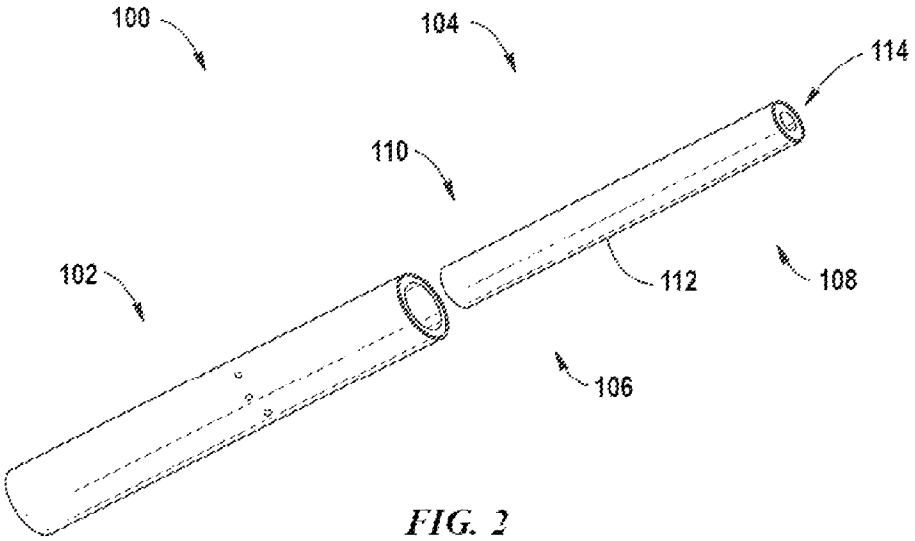
Figure 3:
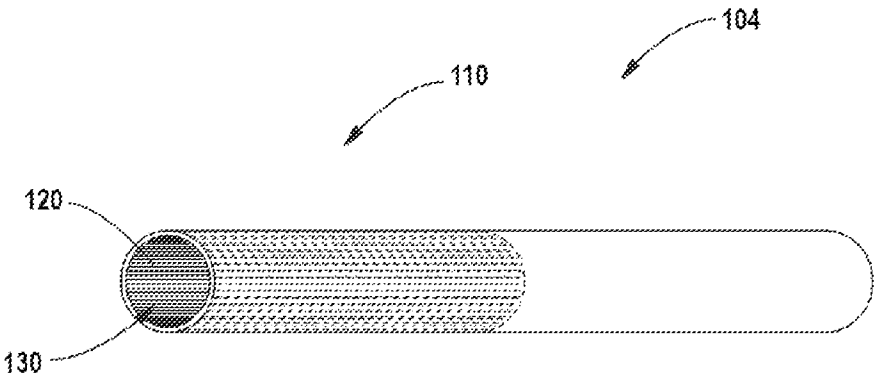
Figure 4:
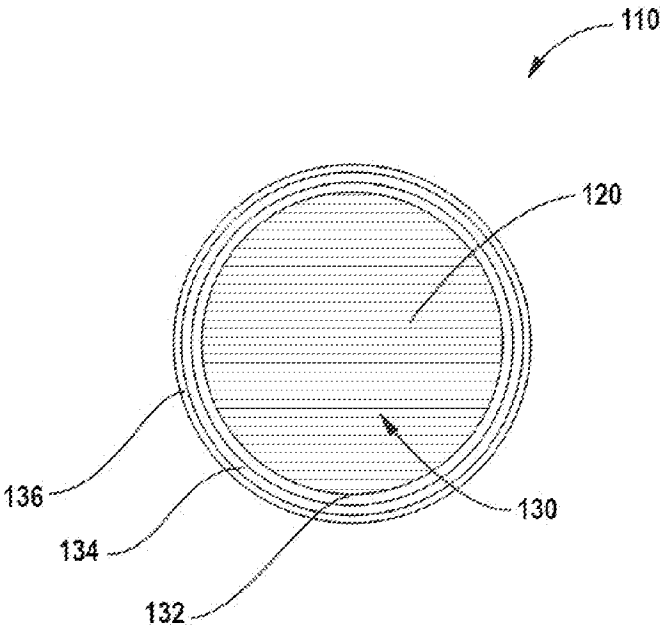
Figure 5:
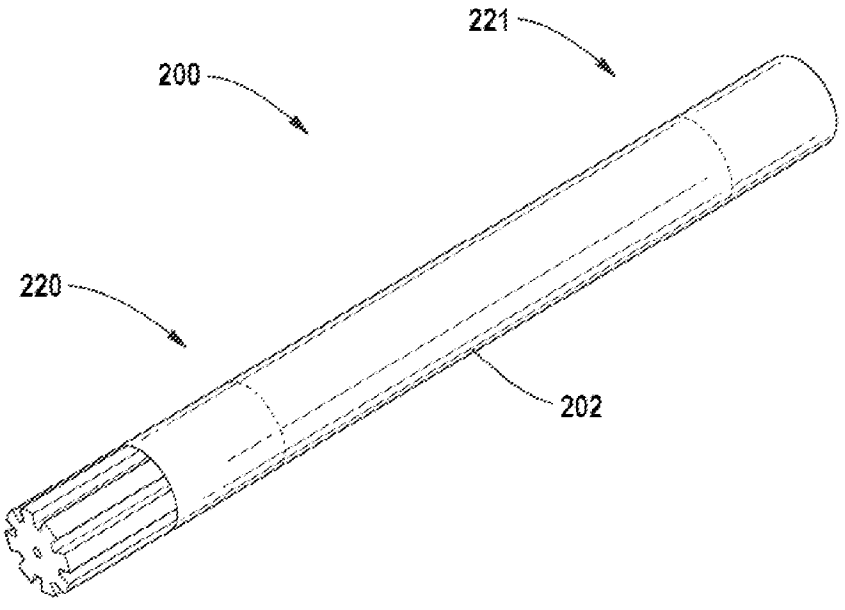
Figure 6:
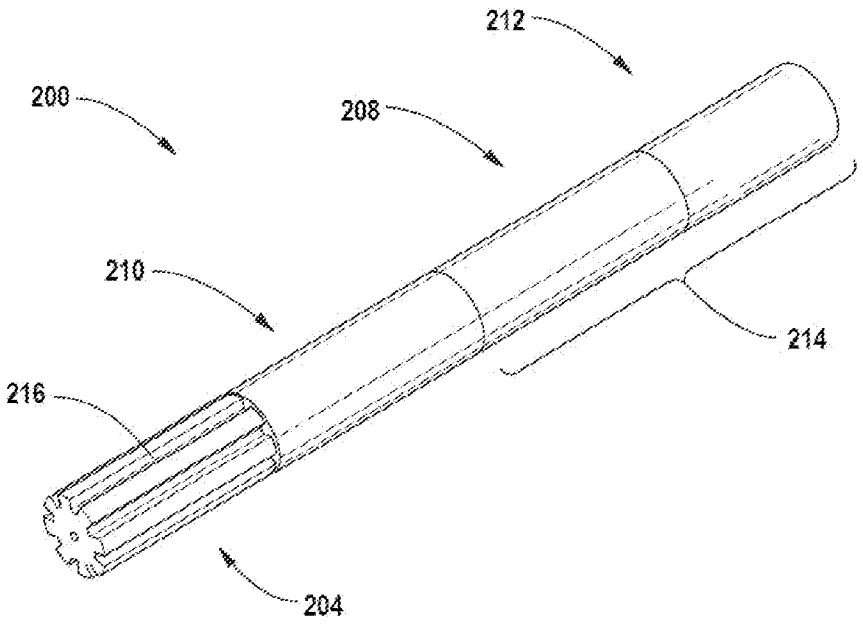

FIG. 1 illustrates a perspective view of an aerosol delivery device comprising a control body and an aerosol generating component, wherein the generating component and the control body are coupled to one another, according to an example embodiment of the present disclosure;

FIG. 2 illustrates a perspective view of the aerosol delivery device of FIG. 1 wherein the aerosol generating component and the control body are decoupled from one another, according to an example embodiment of the present disclosure;

FIG. 3 illustrates a perspective schematic view of an aerosol generating component, according to an example embodiment of the disclosure;

FIG. 4 illustrates a schematic cross-section drawing of a substrate portion of an aerosol generating component, according to an example embodiment of the present disclosure;

FIG. 5 illustrates a perspective view of an aerosol generating component, according to an example embodiment of the present disclosure; and FIG. 6 illustrates a perspective view of the aerosol generating component of FIG. 5 with an outer wrap removed, according to one embodiment of the present disclosure.

DETAILED DESCRIPTION

The present disclosure will now be described more fully hereinafter with reference to example embodiments thereof. These example embodiments are described so that this disclosure will be thorough and complete, and will fully convey the scope of the disclosure to those skilled in the art. Indeed, the disclosure may be embodied in many different forms and should not be construed as limited to the embodiments set forth herein; rather, these embodiments are provided so that this disclosure will satisfy applicable legal requirements. As used in this specification and the claims, the singular forms "a," "an," and "the" include plural referents unless the context clearly dictates otherwise. Reference to "dry weight percent" or "dry weight basis" refers to weight on the basis of dry ingredients (i.e., all ingredients except water). Reference to percent is intended to mean percent by weight unless otherwise indicated.

Aerosol delivery devices wherein a solid fuel, such as carbon, is combusted to transfer heat to tobacco, as well as aerosol delivery devices utilizing electrically generated heat, have aerosol forming substrates as part of the aerosol generating component. Such substrates generally comprise a reconstituted tobacco material, which are typically made via processes involving the use of wood pulp or cellulose to facilitate throughput and provide adequate tensile strength in the final product. Whether from hard or soft wood, most pulp used for reconstituted tobacco materials is derived via the Kraft process or other pulping or bleaching processes which utilize sulfur. For example, the Kraft process involves the use of sulfite salts, especially for the removal of lignin, which may otherwise interfere with wet web/paper formation, leading to paper aerosol forming substrates with low tensile strength. Residual sulfur compounds present in the aerosol forming substrates from the pulping or bleaching process may be volatilized and transferred to the consumer in the generated aerosol, for example as $SO_2$, sulfite, sulfate, and the like. Further, sulfur containing compounds (e.g., amino acids or proteins with thiol or disulfide bonds) which may naturally be present in the aerosol forming substrate could be converted to volatile sulfur compounds and transferred to the consumer in the generated aerosol. Such sulfur compounds, regardless of origin, represent one of the most common off-taste sensory qualities found in tobacco heat-not-burn (HNB) products. Accordingly, in both types of aerosol delivery devices, it would be advantageous to provide an aerosol forming substrate which is substantially free of sulfur compounds to prevent formation of off-taste sensory qualities.

As described hereinafter, example embodiments of the present disclosure relate to an aerosol generating component comprising a substrate carrying one or more aerosol forming materials, the substrate comprising a cellulosic material substantially free of sulfur compounds, and further comprising one or more of a tobacco pulp, an aqueous tobacco extract, a filler, and a binder. Further example embodiments of the present disclosure relate to an aerosol delivery device comprising the aerosol generating component as disclosed herein; a heat source configured to heat the aerosol forming materials carried in the substrate portion to form an aerosol; and an aerosol pathway extending from the aerosol generating component to a mouth-end of the aerosol delivery device.

Aerosol Generating Components and Aerosol Delivery Devices

Some embodiments of aerosol generating components according to the present disclosure use electrical energy to heat a material to form an inhalable substance (e.g., electrically heated tobacco products). Other embodiments of aerosol generating components according to the present disclosure use an ignitable heat source to heat a material (preferably without combusting the material to any significant degree) to form an inhalable substance (e.g., carbon heated tobacco products). Preferably, the material is heated without combusting the material to any significant degree. Components of such systems have the form of articles that are sufficiently compact to be considered hand-held devices. That is, use of components of preferred aerosol delivery devices does not result in the production of smoke in the sense that aerosol results principally from by-products of combustion or pyrolysis of tobacco, but rather, use of those preferred systems results in the production of vapors resulting from volatilization or vaporization of certain components incorporated therein. In some example embodiments, components of aerosol delivery devices may be characterized as electronic cigarettes, and those electronic cigarettes most preferably incorporate tobacco and/or components derived from tobacco, and hence deliver tobacco derived components in aerosol form.

Aerosol generating components of certain preferred aerosol delivery devices may provide many of the sensations (e.g., inhalation and exhalation rituals, types of tastes or flavors, organoleptic effects, physical feel, use rituals, visual cues such as those provided by visible aerosol, and the like) of smoking a cigarette, cigar or pipe that is employed by lighting and burning tobacco (and hence inhaling tobacco smoke), without any substantial degree of combustion of any component thereof. For example, the user of an aerosol delivery device in accordance with some example embodiments of the present disclosure can hold and use that component much like a smoker employs a traditional type of smoking article, draw on one end of that piece for inhalation of aerosol produced by that piece, take or draw puffs at selected intervals of time, and the like.

While the systems are generally described herein in terms of embodiments associated with aerosol delivery devices and/or aerosol generating components such as so-called "e-cigarettes" or "tobacco heating products," it should be understood that the mechanisms, components, features, and methods may be embodied in many different forms and associated with a variety of articles. For example, the description provided herein may be employed in conjunction with embodiments of traditional smoking articles (e.g., cigarettes, cigars, pipes, etc.), heat-not-burn cigarettes, and related packaging for any of the products disclosed herein. Accordingly, it should be understood that the description of the mechanisms, components, features, and methods disclosed herein are discussed in terms of embodiments relating to aerosol delivery devices by way of example only, and may be embodied and used in various other products and methods.

Aerosol delivery devices and/or aerosol generating components of the present disclosure may also be characterized as being vapor-producing articles or medicament delivery articles. Thus, such articles or devices may be adapted so as to provide one or more substances (e.g., flavors and/or pharmaceutical active ingredients) in an inhalable form or state. For example, inhalable substances may be substantially in the form of a vapor (i.e., a substance that is in the gas phase at a temperature lower than its critical point). Alternatively, inhalable substances may be in the form of an aerosol (i.e., a suspension of fine solid particles or liquid droplets in a gas). For purposes of simplicity, the term "aerosol" as used herein is meant to include vapors, gases and aerosols of a form or type suitable for human inhalation, whether or not visible, and whether or not of a form that might be considered to be smoke-like. The physical form of the inhalable substance is not necessarily limited by the nature of the inventive devices but rather may depend upon the nature of the medium and the inhalable substance itself as to whether it exists in a vapor state or an aerosol state. In some embodiments, the terms "vapor" and "aerosol" may be interchangeable. Thus, for simplicity, the terms "vapor" and "aerosol" as used to describe aspects of the disclosure are understood to be interchangeable unless stated otherwise.

In some embodiments, aerosol delivery devices of the present disclosure may comprise some combination of a power source (e.g., an electrical power source), at least one control component (e.g., means for actuating, controlling, regulating and ceasing power for heat generation, such as by controlling electrical current flow from the power source to other components of the article, e.g., a microprocessor, individually or as part of a microcontroller), a heat source (e.g., an electrical resistance heating element or other component and/or an inductive coil or other associated components and/or one or more radiant heating elements), and an aerosol generating component that includes a substrate portion capable of yielding an aerosol upon application of sufficient heat. Note that it is possible to physically combine one or more of the above-noted components. For instance, in certain embodiments, a conductive heater trace can be printed on the surface of a substrate material as described herein (e.g., a cellulosic film) using a conductive ink such that the heater trace can be powered by the power source and used as the resistance heating element. Example conductive inks include graphene inks and inks containing various metals, such as inks including silver, gold, palladium, platinum, and alloys or other combinations thereof (e.g., silver-palladium or silver-platinum inks), which can be printed on a surface using processes such as gravure printing, flexographic printing, off-set printing, screen printing, ink-jet printing, or other appropriate printing methods.

In various embodiments, a number of these components may be provided within an outer body or shell, which, in some embodiments, may be referred to as a housing. The overall design of the outer body or shell may vary, and the format or configuration of the outer body that may define the overall size and shape of the aerosol delivery device may vary. Although other configurations are possible, in some embodiments an elongated body resembling the shape of a cigarette or cigar may be a formed from a single, unitary housing or the elongated housing can be formed of two or more separable bodies. For example, an aerosol delivery device may comprise an elongated shell or body that may be substantially tubular in shape and, as such, resemble the shape of a conventional cigarette or cigar. In one example, all of the components of the aerosol delivery device are contained within one housing or body. In other embodiments, an aerosol delivery device may comprise two or more housings that are joined and are separable. For example, an aerosol delivery device may possess at one end a control body comprising a housing containing one or more reusable components (e.g., an accumulator such as a rechargeable battery and/or rechargeable supercapacitor, and various electronics for controlling the operation of that article), and at the other end and removably coupleable thereto, an outer body or shell containing a disposable portion (e.g., a disposable flavor-containing aerosol generating component).

In other embodiments, aerosol generating components of the present disclosure may generally include an ignitable heat source configured to heat a substrate material. The substrate material and/or at least a portion of the heat source may be covered in an outer wrap, or wrapping, a casing, a component, a module, a member, or the like. The overall design of the enclosure is variable, and the format or configuration of the enclosure that defines the overall size and shape of the aerosol generating component is also variable. Although other configurations are possible, it may be desirable, in some aspects, that the overall design, size, and/or shape of these embodiments resemble that of a conventional cigarette or cigar. In various aspects, the heat source may be capable of generating heat to aerosolize a substrate material that comprises, for example, a substrate material associated with an aerosol forming materials, an extruded structure and/or substrate, tobacco and/or a tobacco related material, such as a material that is found naturally in tobacco that is isolated directly from the tobacco or synthetically prepared, in a solid or liquid form (e.g., beads, sheets, shreds, a wrap), or the like.

More specific formats, configurations and arrangements of various substrate materials, aerosol generating components, and components within aerosol delivery devices of the present disclosure will be evident in light of the further disclosure provided hereinafter. Additionally, the selection of various aerosol delivery device components may be appreciated upon consideration of the commercially available electronic aerosol delivery devices. Further, the arrangement of the components within the aerosol delivery device may also be appreciated upon consideration of the commercially available electronic aerosol delivery devices.

In this regard, FIG. 1 illustrates an aerosol delivery device 100 according to an example embodiment of the present disclosure. The aerosol delivery device 100 may include a control body 102 and an aerosol generating component 104. In various embodiments, the aerosol generating component 104 and the control body 102 may be permanently or detachably aligned in a functioning relationship. In this regard, FIG. 1 illustrates the aerosol delivery device 100 in a coupled configuration, whereas FIG. 2 illustrates the aerosol delivery device 100 in a decoupled configuration. Various mechanisms may connect the aerosol generating component 104 to the control body 102 to result in a threaded engagement, a press-fit engagement, an interference fit, a sliding fit, a magnetic engagement, or the like.

In various embodiments, the aerosol delivery device 100 according to than example embodiment of the present disclosure may have a variety of overall shapes, including, but not limited to an overall shape that may be defined as being substantially rod-like or substantially tubular shaped or substantially cylindrically shaped. In the embodiments of FIGS. 1-2, the device 100 has a substantially round cross-section; however, other cross-sectional shapes (e.g., oval, square, triangle, etc.) also are encompassed by the present disclosure. For example, in some embodiments one or both of the control body 102 or the aerosol generating component 104 (and/or any subcomponents) may have a substantially rectangular shape, such as a substantially rectangular cuboid shape. In other embodiments, one or both of the control body 102 or the aerosol generating component 104 (and/or any subcomponents) may have other hand-held shapes. For example, in some embodiments the control body 102 may have a small box shape, various pod mod shapes, or a fob-shape. Thus, such language that is descriptive of the physical shape of the article may also be applied to the individual components thereof, including the control body 102 and the aerosol generating component 104.

Alignment of the components within the aerosol delivery device of the present disclosure may vary across various embodiments. In some embodiments, the substrate portion may be positioned proximate a heat source so as to maximize aerosol delivery to the user. Other configurations, however, are not excluded. Generally, the heat source may be positioned sufficiently near the substrate portion so that heat from the heat source can volatilize the substrate portion (as well as, in some embodiments, one or more flavorants, active ingredients, or the like that may likewise be provided for delivery to a user) and form an aerosol for delivery to the user. When the heat source heats the substrate portion, an aerosol is formed, released, or generated in a physical form suitable for inhalation by a consumer. It should be noted that the foregoing terms are meant to be interchangeable such that reference to release, releasing, releases, or released includes form or generate, forming or generating, forms or generates, and formed or generated. Specifically, an inhalable substance is released in the form of a vapor or aerosol or mixture thereof, wherein such terms are also interchangeably used herein except where otherwise specified.

As noted above, the aerosol delivery device 100 of various embodiments may incorporate a battery and/or other electrical power source to provide current flow sufficient to provide various functionalities to the aerosol delivery device, such as powering of the heat source, powering of control systems, powering of indicators, and the like. As will be discussed in more detail below, the power source may take on various embodiments. Preferably, the power source may be able to deliver sufficient power to rapidly activate the heat source to provide for aerosol formation and power the aerosol delivery device through use for a desired duration of time. In some embodiments, the power source is sized to fit conveniently within the aerosol delivery device so that the aerosol delivery device can be easily handled. Examples of useful power sources include lithium-ion batteries that are preferably rechargeable (e.g., a rechargeable lithium-manganese dioxide battery). In particular, lithium polymer batteries can be used as such batteries can provide increased safety. Other types of batteries—e.g., N50-AAA CADNICA nickel-cadmium cells—may also be used. Additionally, a preferred power source is of a sufficiently light weight to not detract from a desirable smoking experience. Some examples of possible power sources are described in U.S. Pat. No. 9,484,155 to Peckerar et al., and U.S. Pat. App. Pub. No. 2017/0112191 to Sur et al., the disclosures of which are incorporated herein by reference in their respective entireties.

In specific embodiments, one or both of the control body 102 and the aerosol generating component 104 may be referred to as being disposable or as being reusable. For example, the control body 102 may have a replaceable battery or a rechargeable battery, solid-state battery, thin-film solid-state battery, rechargeable supercapacitor or the like, and thus may be combined with any type of recharging technology, including connection to a wall charger, connection to a car charger (i.e., cigarette lighter receptacle), and connection to a computer, such as through a universal serial bus (USB) cable or connector (e.g., USB 2.0, 3.0, 3.1, USB Type-C), connection to a photovoltaic cell (sometimes referred to as a solar cell) or solar panel of solar cells, a wireless charger, such as a charger that uses inductive wireless charging (including for example, wireless charging according to the Qi wireless charging standard from the Wireless Power Consortium (WPC)), or a wireless radio frequency (RF) based charger. An example of an inductive wireless charging system is described in U.S. Pat. App. Pub. No. 2017/0112196 to Sur et al., which is incorporated herein by reference in its entirety. Further, in some embodiments, the aerosol generating component 104 may comprise a single-use device. A single use component for use with a control body is disclosed in U.S. Pat. No. 8,910,639 to Chang et al., which is incorporated herein by reference in its entirety.

In further embodiments, the power source may also comprise a capacitor. Capacitors are capable of discharging more quickly than batteries and can be charged between puffs, allowing the battery to discharge into the capacitor at a lower rate than if it were used to power the heat source directly. For example, a supercapacitor—e.g., an electric double-layer capacitor (EDLC)—may be used separate from or in combination with a battery. When used alone, the supercapacitor may be recharged before each use of the article. Thus, the device may also include a charger component that can be attached to the smoking article between uses to replenish the supercapacitor.

Further components may be utilized in the aerosol delivery device of the present disclosure. For example, the aerosol delivery device may include a flow sensor that is sensitive either to pressure changes or air flow changes as the consumer draws on the article (e.g., a puff-actuated switch). Other possible current actuation/deactuation mechanisms may include a temperature actuated on/off switch or a lip pressure actuated switch. An example mechanism that can provide such puff-actuation capability includes a Model 163PC01D36 silicon sensor, manufactured by the MicroSwitch division of Honeywell, Inc., Freeport, Ill. Representative flow sensors, current regulating components, and other current controlling components including various microcontrollers, sensors, and switches for aerosol delivery devices are described in U.S. Pat. No. 4,735,217 to Gerth et al., U.S. Pat. Nos. 4,922,901, 4,947,874, and 4,947,875, all to Brooks et al., U.S. Pat. No. 5,372,148 to McCafferty et al., U.S. Pat. No. 6,040,560 to Fleischhauer et al., U.S. Pat. No. 7,040,314 to Nguyen et al., and U.S. Pat. No. 8,205,622 to Pan, all of which are incorporated herein by reference in their entireties. Reference is also made to the control schemes described in U.S. Pat. No. 9,423,152 to Ampolini et al., which is incorporated herein by reference in its entirety.

In another example, an aerosol delivery device may comprise a first conductive surface configured to contact a first body part of a user holding the device, and a second conductive surface, conductively isolated from the first conductive surface, configured to contact a second body part of the user. As such, when the aerosol delivery device detects a change in conductivity between the first conductive surface and the second conductive surface, a vaporizer is activated to vaporize a substance so that the vapors may be inhaled by the user holding unit. The first body part and the second body part may be a lip or parts of a hand(s). The two conductive surfaces may also be used to charge a battery contained in the personal vaporizer unit. The two conductive surfaces may also form, or be part of, a connector that may be used to output data stored in a memory. Reference is made to U.S. Pat. No. 9,861,773 to Terry et al., which is incorporated herein by reference in its entirety.

In addition, U.S. Pat. No. 5,154,192 to Sprinkel et al. discloses indicators for smoking articles; U.S. Pat. No. 5,261,424 to Sprinkel, Jr. discloses piezoelectric sensors that can be associated with the mouth-end of a device to detect user lip activity associated with taking a draw and then trigger heating of a heating device; U.S. Pat. No. 5,372,148 to McCafferty et al. discloses a puff sensor for controlling energy flow into a heating load array in response to pressure drop through a mouthpiece; U.S. Pat. No. 5,967,148 to Harris et al. discloses receptacles in a smoking device that include an identifier that detects a non-uniformity in infrared transmissivity of an inserted component and a controller that executes a detection routine as the component is inserted into the receptacle; U.S. Pat. No. 6,040,560 to Fleischhauer et al. describes a defined executable power cycle with multiple differential phases; U.S. Pat. No. 5,934,289 to Watkins et al. discloses photonic-optronic components; U.S. Pat. No. 5,954,979 to Counts et al. discloses means for altering draw resistance through a smoking device; U.S. Pat. No. 6,803,545 to Blake et al. discloses specific battery configurations for use in smoking devices; U.S. Pat. No. 7,293,565 to Griffen et al. discloses various charging systems for use with smoking devices; U.S. Pat. No. 8,402,976 to Fernando et al. discloses computer interfacing means for smoking devices to facilitate charging and allow computer control of the device; U.S. Pat. No. 8,689,804 to Fernando et al. discloses identification systems for smoking devices; and PCT Pat. App. Pub. No. WO 2010/003480 by Flick discloses a fluid flow sensing system indicative of a puff in an aerosol generating system; all of the foregoing disclosures being incorporated herein by reference in their entireties.

Further examples of components related to electronic aerosol delivery articles and disclosing materials or components that may be used in the present device include U.S. Pat. No. 4,735,217 to Gerth et al.; U.S. Pat. No. 5,249,586 to Morgan et al.; U.S. Pat. No. 5,666,977 to Higgins et al.; U.S. Pat. No. 6,053,176 to Adams et al.; U.S. Pat. No. 6,164,287 to White; U.S. Pat. No. 6,196,218 to Voges; U.S. Pat. No. 6,810,883 to Felter et al.; U.S. Pat. No. 6,854,461 to Nichols; U.S. Pat. No. 7,832,410 to Hon; U.S. Pat. No. 7,513,253 to Kobayashi; U.S. Pat. No. 7,896,006 to Hamano; U.S. Pat. No. 6,772,756 to Shayan; U.S. Pat. Nos. 8,156,944 and 8,375,957 to Hon; U.S. Pat. No. 8,794,231 to Thorens et al.; U.S. Pat. No. 8,851,083 to Oglesby et al.; U.S. Pat. Nos. 8,915,254 and 8,925,555 to Monsees et al.; U.S. Pat. No. 9,220,302 to DePiano et al.; U.S. Pat. App. Pub. Nos. 2006/0196518 and 2009/0188490 to Hon; U.S. Pat. App. Pub. No. 2010/0024834 to Oglesby et al.; U.S. Pat. App. Pub. No. 2010/0307518 to Wang; PCT Pat. App. Pub. No. WO 2010/091593 to Hon; and PCT Pat. App. Pub. No. WO 2013/089551 to Foo, each of which is incorporated herein by reference in its entirety. Further, U.S. Pat. App. Pub. No. 2017/0099877 to Worm et al. discloses capsules that may be included in aerosol delivery devices and fob-shape configurations for aerosol delivery devices, and is incorporated herein by reference in its entirety. A variety of the materials disclosed by the foregoing documents may be incorporated into the present devices in various embodiments, and all of the foregoing disclosures are incorporated herein by reference in their entireties.

Referring to FIG. 2, in the depicted embodiment, the aerosol generating component 104 comprises a heated end 106, which is configured to be inserted into the control body 102, and a mouth end 108, upon which a user draws to create the aerosol. At least a portion of the heated end 106 may include a substrate portion 110. In some embodiments, the substrate portion 110 is loaded with the aerosol forming material as described herein. As will be discussed in more detail below, in various embodiments the substrate portion 110 may comprise various materials impregnated with the aerosol forming materials. In various embodiments, the aerosol generating component 104, or a portion thereof, may be wrapped in an exterior overwrap material 112. In various embodiments, the mouth end 108 of the aerosol generating component 104 may include a filter 114, which may, for example, be made of a cellulose acetate or polypropylene material. The filter 114 may additionally or alternatively contain strands of tobacco containing material, such as described in U.S. Pat. No. 5,025,814 to Raker et al., which is incorporated herein by reference in its entirety. In various embodiments, the filter 114 may increase the structural integrity of the mouth end of the aerosol source member, and/or provide filtering capacity, if desired, and/or provide resistance to draw. In some embodiments, the filter may comprise discrete segments. For example, some embodiments may include a segment providing filtering, a segment providing draw resistance, a hollow segment providing a space for the aerosol to cool, a segment providing increased structural integrity, other filter segments, and any one or any combination of the above.

In some embodiments, the material of the exterior overwrap 112 may comprise a material that resists transfer of heat, which may include a paper or other fibrous material, such as a cellulose material. The exterior overwrap material may also include at least one filler material imbedded or dispersed within the fibrous material. In various embodiments, the filler material may have the form of water insoluble particles. Additionally, the filler material may incorporate inorganic components. In various embodiments, the exterior overwrap may be formed of multiple layers, such as an underlying, bulk layer and an overlying layer, such as a typical wrapping paper in a cigarette. Such materials may include, for example, lightweight "rag fibers" such as flax, hemp, sisal, rice straw, and/or esparto. The exterior overwrap may also include a material typically used in a filter element of a conventional cigarette, such as cellulose acetate. Further, an excess length of the exterior overwrap at the mouth end 108 of the aerosol generating component may function to simply separate the substrate portion 110 from the mouth of a consumer or to provide space for positioning of a filter material, as described below, or to affect draw on the article or to affect flow characteristics of the vapor or aerosol leaving the device during draw. Further discussions relating to the configurations for exterior overwrap materials that may be used with the present disclosure may be found in U.S. Pat. No. 9,078,473 to Worm et al., which is incorporated herein by reference in its entirety.

FIG. 3 illustrates a perspective schematic view of an aerosol generating component according to an example embodiment of the disclosure. In particular, FIG. 3 illustrates the aerosol generating component 104 having a substrate portion 110 that comprises a series of overlapping layers 130 of a substrate in sheet form 120. With reference to the description above, in the depicted embodiment, the substrate sheet 120 comprises a film or layer as disclosed herein. In various embodiments, the term "overlapping layers" may also include bunched, crumpled, crimped, and/or otherwise gathered layers in which the individual layers may not be obvious.

For example, FIG. 4 illustrates a schematic cross-section drawing of a substrate portion of an aerosol generating component according to an example embodiment of the present disclosure. In particular, FIG. 4 illustrates the substrate portion 110, which comprises a series of overlapping layers 130 of the substrate sheet 120. In the depicted embodiment, at least a portion of the overlapping layers 130 is substantially surrounded about its outer surface with a first cover layer 132. Although in various embodiments the composition of the first cover layer 132 may vary, in the depicted embodiment the first cover layer 132 comprises a combination of a fibrous material, the aerosol forming materials, and a binder material. Reference is made to the discussions herein relating possible aerosol forming materials and binder materials.

In various embodiments, the first cover layer 132 may be constructed via a casting process, such as that described in U.S. Pat. No. 5,697,385 to Seymour et al., the disclosure of which is incorporated herein by reference in its entirety.

In the depicted embodiment, at least a portion of the overlapping layers 130 and the first cover layer 132 are substantially surrounded about an outer surface with a second cover layer 134. Although the composition of the second cover layer 134 may vary, in the depicted embodiment the second cover layer 134 comprises a metal foil material, such as an aluminum foil material. In other embodiments, the second cover layer may comprise other materials, including, but not limited to, a copper material, a tin material, a gold material, an alloy material, a ceramic material, or other thermally conductive amorphous carbon-based material, and/or any combinations thereof. The depicted embodiment further includes a third cover layer 136, which substantially surrounds the overlapping layers 130, first cover layer 132, and the second cover layer 134, about an outer surface thereof. In the depicted embodiment, the third cover layer 136 comprises a paper material, such as a conventional cigarette wrapping paper. In various embodiments, the paper material may comprise rag fibers, such as non-wood plant fibers, and may include flax, hemp, sisal, rice straw, and/or esparto fibers.

In various embodiments, other components may exist between the substrate portion 110 and the mouth end 108 of the aerosol generating component 104. For example, in some embodiments one or any combination of the following may be positioned between the substrate portion 110 and the mouth end 108 of the aerosol generating component 104: an air gap; a hollow tube structure; phase change materials for cooling air; flavor releasing media; ion exchange fibers capable of selective chemical adsorption; aerogel particles as filter medium; and other suitable materials. Some examples of possible phase change materials include, but are not limited to, salts, such as $AgNO_3$, $AlCl_3$, $TaCl_3$, $InCl_3$, $SnCl_2$, $AlI_3$, and $TiI_4$; metals and metal alloys such as selenium, tin, indium, tin-zinc, indium-zinc, or indium-bismuth; and organic compounds such as D-mannitol, succinic acid, p-nitrobenzoic acid, hydroquinone and adipic acid. Other examples are described in U.S. Pat. No. 8,430,106 to Potter et al., which is incorporated herein by reference in its entirety.

As will be discussed in more detail below, the presently disclosed aerosol generating component is configured for use with a conductive and/or inductive heat source to heat a substrate material to form an aerosol. In various embodiments, a conductive heat source may comprise a heating assembly that comprises a resistive heating member. Resistive heating members may be configured to produce heat when an electrical current is directed therethrough. Electrically conductive materials useful as resistive heating members may be those having low mass, low density, and moderate resistivity and that are thermally stable at the temperatures experienced during use. Useful heating members heat and cool rapidly, and thus provide for the efficient use of energy. Rapid heating of the member may be beneficial to provide almost immediate volatilization of an aerosol forming materials in proximity thereto. Rapid cooling prevents substantial volatilization (and hence waste) of the aerosol forming materials during periods when aerosol formation is not desired. Such heating members may also permit relatively precise control of the temperature range experienced by the aerosol forming materials, especially when time based current control is employed. Useful electrically conductive materials are preferably chemically non-reactive with the materials being heated (e.g., aerosol forming materials and other inhalable substance materials) so as not to adversely affect the flavor or content of the aerosol or vapor that is produced. Some example, non-limiting, materials that may be used as the electrically conductive material include carbon, graphite, carbon/graphite composites, metals, ceramics such as metallic and non-metallic carbides, nitrides, oxides, silicides, inter-metallic compounds, cermets, metal alloys, and metal foils. In particular, refractory materials may be useful. Various, different materials can be mixed to achieve the desired properties of resistivity, mass, and thermal conductivity. In specific embodiments, metals that can be utilized include, for example, nickel, chromium, alloys of nickel and chromium (e.g., nichrome), and steel. Materials that can be useful for providing resistive heating are described in U.S. Pat. No. 5,060,671 to Counts et al.; U.S. Pat. No. 5,093,894 to Deevi et al.; U.S. Pat. No. 5,224,498 to Deevi et al.; U.S. Pat. No. 5,228,460 to Sprinkel Jr., et al.; U.S. Pat. No. 5,322,075 to Deevi et al.; U.S. Pat. No. 5,353,813 to Deevi et al.; U.S. Pat. No. 5,468,936 to Deevi et al.; U.S. Pat. No. 5,498,850 to Das; U.S. Pat. No. 5,659,656 to Das; U.S. Pat. No. 5,498,855 to Deevi et al.; U.S. Pat. No. 5,530,225 to Hajaligol; U.S. Pat. No. 5,665,262 to Hajaligol; U.S. Pat. No. 5,573,692 to Das et al.; and U.S. Pat. No. 5,591,368 to Fleischhauer et al., the disclosures of which are incorporated herein by reference in their entireties.

In various embodiments, a heating member may be provided in a variety of forms, such as in the form of a foil, a foam, a mesh, a hollow ball, a half ball, discs, spirals, fibers, wires, films, yarns, strips, ribbons, or cylinders. Such heating members often comprise a metal material and are configured to produce heat as a result of the electrical resistance associated with passing an electrical current therethrough. Such resistive heating members may be positioned in proximity to, and/or in direct contact with, the substrate portion. For example, in one embodiment, a heating member may comprise a cylinder or other heating device located in the control body 102, wherein the cylinder is constructed of one or more conductive materials, including, but not limited to, copper, aluminum, platinum, gold, silver, iron, steel, brass, bronze, carbon (e.g., graphite), or any combination thereof. In various embodiments, the heating member may also be coated with any of these or other conductive materials. The heating member may be located proximate an engagement end of the control body 102, and may be configured to substantially surround a portion of the heated end 106 of the aerosol generating component 104 that includes the substrate portion 110. In such a manner, the heating member may be located proximate the substrate portion 110 of the aerosol generating component 104 when the aerosol source member is inserted into the control body 102. In other examples, at least a portion of a heating member may penetrate at least a portion of an aerosol generating component (such as, for example, one or more prongs and/or spikes that penetrate an aerosol generating component), when the aerosol generating component is inserted into the control body. Although in some embodiments the heating member may comprise a cylinder, it should be noted that in other embodiments, the heating member may take a variety of forms and, in some embodiments, may make direct contact with and/or penetrate the substrate portion.

As described above, in addition to being configured for use with a conductive heat source, the presently disclosed aerosol generating component may also be configured for use with an inductive heat source to heat a substrate portion to form an aerosol. In various embodiments, an inductive heat source may comprise a resonant transformer, which may comprise a resonant transmitter and a resonant receiver (e.g., a susceptor). In some embodiments, the resonant transmitter and the resonant receiver may be located in the control body 102. In other embodiments, the resonant receiver, or a portion thereof, may be located in the aerosol source member 104. For example, in some embodiments, the control body 102 may include a resonant transmitter, which, for example, may comprise a foil material, a coil, a cylinder, or other structure configured to generate an oscillating magnetic field, and a resonant receiver, which may comprise one or more prongs that extend into the substrate portion or are surrounded by the substrate portion. In some embodiments, the aerosol generating component is in intimate contact with the resonant receiver.

In other embodiments, a resonant transmitter may comprise a helical coil configured to circumscribe a cavity into which an aerosol generating component, and in particular, a substrate portion of an aerosol generating component, is received. In some embodiments, the helical coil may be located between an outer wall of the device and the receiving cavity. In one embodiment, the coil winds may have a circular cross section shape; however, in other embodiments, the coil winds may have a variety of other cross section shapes, including, but not limited to, oval shaped, rectangular shaped, L-shaped, T-shaped, triangular shaped, and combinations thereof. In another embodiment, a pin may extend into a portion of the receiving cavity, wherein the pin may comprise the resonant transmitter, such as by including a coil structure around or within the pin. In various embodiments, an aerosol source member may be received in the receiving cavity wherein one or more components of the aerosol source member may serve as the resonant receiver. In some embodiments, the aerosol generating component comprises the resonant receiver. Other possible resonant transformer components, including resonant transmitters and resonant receivers, are described in U.S. Pat. App. Pub. No. 2019/0124979 to Sebastian et al., which is incorporated herein by reference in its entirety.

As noted above, in various embodiments the substrate portion of the aerosol generating component may comprise a variety of substantially sulfur-free substrate materials impregnated with one or more aerosol forming materials. The substrate and aerosol forming materials are further described herein below.

Substrate

In one aspect is provided an aerosol generating component comprising a substrate impregnated with one or more aerosol forming materials (forming substrate portion 110), the substrate comprising a cellulosic material substantially free of sulfur compounds. By "impregnated" it is meant that the substrate carries, holds, has absorbed in or on, or adsorbed in or on, or is associated with, and the like, the one or more aerosol forming materials. Such terms are used interchangeably without limiting the method or extent to which the substrate holds the one or more aerosol forming materials, and such terms as carried, impregnated, held, and the like are intended to encompass any means of introducing the aerosol forming materials into or on the substrate. By "substantially free of sulfur compounds" is meant that the concentration of sulfur compounds (e.g., sulfates, sulfites, sulfides, and the like) in the cellulosic material is less than about 350 ppm based on the weight of the cellulosic material, measured as sulfate and reported as elemental sulfur. For example, in some embodiments, the sulfur content of the cellulosic material is less than about 325 ppm, less than about 300 ppm, less than about 250 ppm, less than about 200 ppm, less than about 150 ppm, or less than about 100 ppm sulfur, based on the weight of cellulosic material. Example ranges for sulfur content include about 100 ppm to about 350 ppm, such as about 150 ppm to about 300 ppm or about 175 ppm to about 275 ppm. Suitable cellulosic materials include lignocellulose-free cellulosic fiber, non-Kraft or sulfur-free treated wood pulp or cellulosic fibers therefrom, regenerated cellulose materials, cellulose ethers, or combinations thereof.

Lignocellulose is the fibrous component of wood pulp, and is a complex matrix comprising many different polysaccharides, phenolic polymers and proteins. In making cellulosic materials (e.g., paper) from wood pulp, it is desirable to remove lignin from the cellulose to provide a stronger, higher quality cellulosic material. Removal of lignin is typically performed by processes which use sulfur-containing compounds (e.g., the Kraft or sulfite processes), rendering cellulosic materials so obtained unsuitable as substrates for the present disclosure. By "non-Kraft or sulfur-free treated wood pulp" is meant a cellulosic pulp obtained from wood through mechanical and/or organic solvent processes, and which has been processed so as not to introduce sulfur compounds beyond those which may be present in the wood prior to pulping. Alternatively, the cellulosic material may be obtained from a plant which does not comprise lignocellulose, such as flax, cotton linters, kenaf, hibiscus, hemp, tobacco, sisal, rice straw, or esparto. In some embodiments, the substrate is substantially free of wood pulp, meaning that the substrate is substantially free of cellulosic pulp obtained from wood. For example, certain embodiments can be characterized as having less than 1% by weight, or less than 0.5% by weight, or less than 0.1% by weight of wood pulp (or cellulosic pulp obtained from wood), or 0% by weight of wood pulp. In some embodiments, the cellulosic pulp is derived from flax, cotton linters, kenaf, hibiscus, hemp, tobacco, or a combination thereof.

In some embodiments, the cellulosic material comprises a nanocellulose material. As used herein, "nanocellulose material" refers to cellulose materials having at least one average particle size dimension in the range of about 1 nm to about 100 nm. As a non-limiting example, a suitable nanocellulose material may be a fibrous material prepared from any suitable cellulose-containing material, such as grasses (e.g., bamboo), cotton, tobacco, algae, and other plant-based materials, wherein the fiber is further refined such that a nano-fibrillated cellulose fiber is produced.

In some embodiments, the cellulosic material is a cellulosic pulp or regenerated cellulose comprising at least about 90% cellulose by weight, such as about 90%, about 95%, about 99%, or even 100% cellulose. By "regenerated cellulose" is meant a natural cellulose that has been converted to a soluble or dissolving cellulosic derivative, and subsequently regenerated, typically by forming a fiber through polymer spinning, or through film polymer casting, precipitation or extrusion.

The cellulosic pulp can be in the form of a dissolving-grade pulp, which is pulp comprising greater than 85% by weight, typically greater than 88%, or more typically greater than 90% alpha cellulose. The quantity of hemicelluloses (complex polymers composed of various five and six-carbon sugars in a highly branched structure) may also be low (e.g., from about 0.5% to about 10% by weight) in dissolving grade pulp. Additionally, the quantity of lignin in dissolving grade pulp may also be very low (e.g., from about 0% to about 0.2% by weight). Further characteristics of dissolving grade pulp may include: pentosan (from about 0% to about 5% by weight), ash (from about 0% to about 0.15% by weight), alcohol-benzene extractives (from about 0% to about 0.5% by weight), brightness (about 85% or greater), viscosity (from about 5% to about 25%, 1% Cuprammonium), and a copper number from about 0.1 to about 1.2.

The degree of polymerization (DP) of the dissolving grade pulp can be, for example, less than about 750, less than about 500, or from about 100 to about 750, and, in certain embodiments, not more than about 5%, not more than about 10%, not more than about 15%, or between about 5% and about 15% of the material can have a particle size of less than about 3 μm, less than about 5 μm, or less than about 10 μm.

The health of cellulose chains in pulp is often assessed using a 0.5% cupriethylenediamine (CED) viscosity test. In this test, the pulp is dissolved in a common cuprammonium-based agent, at a concentration of 0.5% by weight. The viscosity of the solution is then measured, using a capillary viscometer. The viscosity of the dissolving grade pulp can, for example, define a viscosity of less than about 15 centipoise, less than about 10 centipoise, less than about 5 centipoise, at least about 4 centipoise, or between about 2 centipoise and about 15 centipoise.

The degree of polymerization of the dissolving grade pulp can be estimated by diluting the 0.5% solution stepwise, then measuring the viscosity of each solution. A linear relationship can be generated, and the line can be extrapolated back to the equivalent point of 0% concentration of cellulose in solvent. This value can then be used to calculate the molecular weight of the cellulose. The value obtained for molecular weight can then divided by the weight of the anhydroglucan monomer (weight=162) to obtain the cellulose degree of polymerization.

In this regard, the test used for determining the lignin content of a substance is the "Kappa number" test, which consists of oxidation of the tested substance with potassium permanganate, followed by titration of the reaction liquid to see how much of the applied permanganate can be consumed. Lignin can be easily oxidized this way, while carbohydrates (e.g., hemicellulose and cellulose) cannot. Ideally, a "pure" cellulose or carbohydrate material should have a Kappa number less than 1. The cellulosic pulp can define a Kappa number of, for example, less than about 30, less than about 25, less than about 23, or between about 20 and about 30 in some embodiments.

In some embodiments, the cellulosic material is a cellulose ether (including carboxyalkyl ethers), meaning a cellulose polymer with the hydrogen of one or more hydroxyl groups in the cellulose structure replaced with an alkyl, hydroxyalkyl, or aryl group. Non-limiting examples of such cellulose derivatives include methylcellulose, hydroxypropylcellulose ("HPC"), hydroxypropylmethylcellulose ("HPMC"), hydroxyethyl cellulose, and carboxymethylcellulose ("CMC"). Suitable cellulose ethers include hydroxypropylcellulose, such as Klucel H from Aqualon Co.; hydroxypropylmethylcellulose, such as Methocel K4MS from The Dow Chemical Co.; hydroxyethylcellulose, such as Natrosol 250 MRCS from Aqualon Co.; microcrystalline cellulose, such as Avicel from FMC; methylcellulose, such as Methocel A4M from The Dow Chemical Co.; and sodium carboxymethylcellulose, such as CMC 7HF and CMC 7H4F from Hercules Inc. In one embodiment, the cellulose ether is selected from the group consisting of methylcellulose, hydroxypropylcellulose, hydroxypropylmethylcellulose, hydroxyethyl cellulose, carboxymethylcellulose, and combinations thereof.

The quantity of cellulosic material present in the substrate may vary, but is typically greater than about 10%, such as from about 10 to about 30%, about 15 to about 50%, or about 30 to about 85% by weight, based on the total weight of the substrate. For example, in some embodiments, the quantity of cellulosic material present in the substrate is about 10%, about 15%, about 20%, about 25%, about 30%, about 35%, about 40%, about 45%, about 50%, 55%, about 60%, about 65%, about 70%, about 75%, about 80%, or about 85% by weight, based on the total weight of the substrate.

Binders

In some embodiments, the substrate further comprises a binder. A binder (or combination of binders) may be employed in certain embodiments, in amounts sufficient to provide the desired physical attributes and physical integrity to the substratee. Typical binders can be organic or inorganic, or a combination thereof. Representative binders include povidone, sodium alginate, starches, pectin, gums, dextrans, carrageenan, pullulan, zein, and the like, and combinations thereof. In some implementations, combinations or blends of two or more binder materials may be employed. Other examples of binder materials are described, for example, in U.S. Pat. No. 5,101,839 to Jakob et al.; and U.S. Pat. No. 4,924,887 to Raker et al., each of which is incorporated herein by reference in its entirety.

In some embodiments, the binder is selected from the group consisting of alginates, starches, gums, dextrans, carrageenan, povidone, pullulan, zein, or combinations thereof. In some embodiments, the binder is a starch. Suitable starches include corn starch, rice starch, and modified food starches. In some other embodiments, the binder is rice starch. In some embodiments, the one or more binders is a dextran. In some other embodiments, the binder may include a cyclodextrin.

In some embodiments, the binder is a gum. Suitable gums include xanthan gum, guar gum, gum Arabic, locust bean gum, and gum tragacanth.

In some embodiments, the one or more binders is a carrageenan.

In some embodiments, the binder is an alginate, such as ammonium alginate, propylene glycol alginate, potassium alginate, and sodium alginate. Alginates, and particularly high viscosity alginates, may be employed in conjunction with controlled levels of free calcium ions.

A binder may be employed in amounts sufficient to provide the desired physical attributes and physical integrity to the substrate. When present, the amount of binder utilized can vary, but is typically up to about 30 weight percent, and certain embodiments are characterized by a binder content of at least about 0.1% by weight, such as about 1 to about 30% by weight, or about 5 to about 10% by weight, based on the total weight of the substrate.

Fillers

In some embodiments, the substrate further comprises a filler. Suitable fillers include sugars, sugar alcohols, inorganic substances, and the like. In some embodiments, the filler is selected from the group consisting of maltodextrin, dextrose, calcium carbonate, calcium phosphate, lactose, sugar alcohols, microcrystalline cellulose, and combinations thereof. In some embodiments, the filler is calcium carbonate. Calcium carbonate may also serve as a filter aid during substrate processing.

The amount of filler utilized can vary, but when present, is typically up to about 50 weight percent, and certain embodiments are characterized by a filler content of at least about 0.1% by weight, such as about 1 to about 50% by weight, about 3 to about 45%, or about 5 to about 20% by weight, based on the total weight of the substrate. In some embodiments, the filler content is about 5%, about 10%, about 15%, about 20%, about 25%, about 30%, about 35%, about 40%, about 45%, or about 50% by weight, based on the total weight of the substrate Tobacco Material The substrate may contain tobacco material (e.g., a tobacco pulp) or components therefrom (e.g., a tobacco extract, such as an aqueous tobacco extract). In some embodiments, the tobacco material may comprise a reconstituted tobacco material, such as described in U.S. Pat. No. 4,807,809 to Pryor et al.; U.S. Pat. No. 4,889,143 to Pryor et al. and U.S. Pat. No. 5,025,814 to Raker, the disclosures of which are incorporated herein by reference in their entirety. In some embodiments, the substrate is impregnated with a tobacco extract, such as an aqueous extract. In various embodiments, a tobacco material can be treated to extract a soluble component of the tobacco material therefrom. "Tobacco extract" as used herein refers to the isolated components of a tobacco material that are extracted from solid tobacco pulp by a solvent (e.g., water) that is brought into contact with the tobacco material in an extraction process. Various extraction techniques of tobacco materials can be used to provide a tobacco extract and tobacco solid material. See, for example, the extraction processes described in US Pat. Appl. Pub. No. 2011/0247640 to Beeson et al., which is incorporated herein by reference. Other example techniques for extracting components of tobacco are described in U.S. Pat. No. 4,144,895 to Fiore; U.S. Pat. No. 4,150,677 to Osborne, Jr. et al.; U.S. Pat. No. 4,267,847 to Reid; U.S. Pat. No. 4,289,147 to Wildman et al.; U.S. Pat. No. 4,351,346 to Brummer et al.; U.S. Pat. No. 4,359,059 to Brummer et al.; U.S. Pat. No. 4,506,682 to Muller; U.S. Pat. No. 4,589,428 to Keritsis; U.S. Pat. No. 4,605,016 to Soga et al.; U.S. Pat. No. 4,716,911 to Poulose et al.; U.S. Pat. No. 4,727,889 to Niven, Jr. et al.; U.S. Pat. No. 4,887,618 to Bernasek et al.; U.S. Pat. No. 4,941,484 to Clapp et al.; U.S. Pat. No. 4,967,771 to Fagg et al.; U.S. Pat. No. 4,986,286 to Roberts et al.; U.S. Pat. No. 5,005,593 to Fagg et al.; U.S. Pat. No. 5,018,540 to Grubbs et al.; U.S. Pat. No. 5,060,669 to White et al.; U.S. Pat. No. 5,065,775 to Fagg; U.S. Pat. No. 5,074,319 to White et al.; U.S. Pat. No. 5,099,862 to White et al.; U.S. Pat. No. 5,121,757 to White et al.; U.S. Pat. No. 5,131,414 to Fagg; U.S. Pat. No. 5,131,415 to Munoz et al.; U.S. Pat. No. 5,148,819 to Fagg; U.S. Pat. No. 5,197,494 to Kramer; U.S. Pat. No. 5,230,354 to Smith et al.; U.S. Pat. No. 5,234,008 to Fagg; U.S. Pat. No. 5,243,999 to Smith; U.S. Pat. No. 5,301,694 to Raymond et al.; U.S. Pat. No. 5,318,050 to Gonzalez-Parra et al.; U.S. Pat. No. 5,343,879 to Teague; U.S. Pat. No. 5,360,022 to Newton; U.S. Pat. No. 5,435,325 to Clapp et al.; U.S. Pat. No. 5,445,169 to Brinkley et al.; U.S. Pat. No. 6,131,584 to Lauterbach; U.S. Pat. No. 6,298,859 to Kierulff et al.; U.S. Pat. No. 6,772,767 to Mua et al.; and U.S. Pat. No. 7,337,782 to Thompson, all of which are incorporated by reference herein.

Tobacco materials that may be useful in the present disclosure can vary and may include, for example, flue-cured tobacco, burley tobacco, Oriental tobacco or Maryland tobacco, dark tobacco, dark-fired tobacco and *rustica* tobaccos, as well as other rare or specialty tobaccos, or blends thereof. Tobacco materials also can include so-called "blended" forms and processed forms, such as processed tobacco stems (e.g., cut-rolled or cut-puffed stems), volume expanded tobacco (e.g., puffed tobacco, such as dry ice expanded tobacco (DIET), preferably in cut filler form), reconstituted tobaccos (e.g., reconstituted tobaccos manufactured using paper-making type or cast sheet type processes). Various representative tobacco types, processed types of tobaccos, and types of tobacco blends are set forth in U.S. Pat. No. 4,836,224 to Lawson et al.; U.S. Pat. No. 4,924,888 to Perfetti et al.; U.S. Pat. No. 5,056,537 to Brown et al.; U.S. Pat. No. 5,159,942 to Brinkley et al.; U.S. Pat. No. 5,220,930 to Gentry; U.S. Pat. No. 5,360,023 to Blakley et al.; U.S. Pat. No. 6,701,936 to Shafer et al.; U.S. Pat. No. 7,011,096 to Li et al.; and U.S. Pat. No. 7,017,585 to Li et al.; U.S. Pat. No. 7,025,066 to Lawson et al.; U.S. Pat. App. Pub. No. 2004/0255965 to Perfetti et al.; PCT Pat. App. Pub. No. WO 02/37990 to Bereman; and Bombick et al., Fund. Appl. Toxicol., 39, p. 11-17 (1997); which are incorporated herein by reference in their entireties. Further examples of tobacco compositions that may be useful are disclosed in U.S. Pat. No. 7,726,320 to Robinson et al., which is incorporated herein by reference in its entirety. In some implementations, the milled tobacco material may comprise a blend of flavorful and aromatic tobaccos.

The quantity of tobacco material (e.g. pulp or an extract) present may vary, and when present, is generally less than about 50%, or less than about 20% by weight of the impregnated substrate. For example, a tobacco component may be present in a quantity of from about 0.1%, about 0.5%, about 1%, or about 5%, to about 10%, about 20%, about 30%, about 40%, or about 50% by weight of the substrate.

Botanicals

In some embodiments, the substrate comprises a non-tobacco botanical. As used herein, the term "botanical ingredient" or "botanical" refers to any plant material or fungal-derived material, including plant material in its natural form and plant material derived from natural plant materials, such as extracts or isolates from plant materials or treated plant materials (e.g., plant materials subjected to heat treatment, fermentation, or other treatment processes capable of altering the chemical nature of the material). For the purposes of the present disclosure, a "botanical material" includes but is not limited to "herbal materials," which refer to seed-producing plants that do not develop persistent woody tissue and are often valued for their medicinal or sensory characteristics (e.g., teas or tisanes). Reference to botanical material as "non-tobacco" is intended to exclude tobacco materials (i.e., does not include any nicotiana species). The botanical materials used in the present disclosure may comprise, without limitation, any of the compounds and sources set forth herein, including mixtures thereof. Certain botanical materials of this type are sometimes referred to as dietary supplements, nutraceuticals, "phytochemicals" or "functional foods."

Non-limiting examples of botanical materials include without limitation acai berry, alfalfa, allspice, annatto seed, apricot oil, basil, bee balm, wild bergamot, black pepper, blueberries, borage seed oil, bugleweed, cacao, calamus root, cannabis/hemp, catnip, catuaba, cayenne pepper, chaga mushroom, chervil, cinnamon, dark chocolate, coffee, potato peel, grape seed, ginseng, gingko biloba, Saint John's Wort, saw palmetto, green tea, black tea, black cohosh, cayenne, chamomile, cloves, cocoa powder, cranberry, dandelion, grapefruit, honeybush, echinacea, garlic, evening primrose, feverfew, ginger, goldenseal, hawthorn, hibiscus flower, jiaogulan, kava, lavender, licorice, marjoram, milk thistle, mints (menthe), oolong tea, beet root, orange, oregano, papaya, pennyroyal, peppermint, red clover, rooibos (red or green), rosehip, rosemary, sage, clary sage, savory, spearmint, spirulina, slippery elm bark, sorghum bran hi-tannin, sorghum grain hi-tannin, sumac bran, comfrey leaf and root, goji berries, gutu kola, thyme, turmeric, uva ursi, valerian, wild yam root, wintergreen, yacon root, yellow dock, yerba mate, yerba santa, bacopa monniera, withania somnifera, Lion's mane, and silybum marianum.

The quantity of botanical material present may vary, and when present, is generally less than about 30%, or less than about 20% by weight of the substrate. For example, a botanical material may be present in a quantity of from about 0.1%, about 0.5%, about 1%, or about 5%, to about 10%, about 20%, or about 30% by weight of the substrate.

Aerosol Forming Material

Aerosol generating components as disclosed herein comprise a substrate impregnated with one or more aerosol forming materials. In some embodiments, the aerosol forming material comprises water, polyhydric alcohols, polysorbates, sorbitan esters, fatty acids, fatty acid esters, waxes, cannabinoids, terpenes, sugar alcohols, or a combination thereof.

In some embodiments, the aerosol forming material comprises one or more polyhydric alcohols. Examples of polyhydric alcohols include glycerol, propylene glycol, and other glycols such as 1,3-propanediol, diethylene glycol, and triethylene glycol. In some embodiments, the polyhydric alcohol is selected from the group consisting of glycerol, propylene glycol, 1,3-propanediol, diethylene glycol, triethylene glycol, and combinations thereof.

In some embodiments, the polyhydric alcohol is a mixture of glycerol and propylene glycol. The glycerol and propylene glycol may be present in various ratios, with either component predominating depending on the intended application. In some embodiments, the glycerol and propylene glycol are present in a ratio by weight of from about 3:1 to about 1:3. In some embodiments, the glycerol and propylene glycol are present in a ratio by weight of about 3:1, about 2:1, about 1:1, about 1:2, or about 1:3. In some embodiments, the glycerol and propylene glycol are present in a ratio of about 1:1 by weight.

In some embodiments, the aerosol forming material comprises one or more polysorbates. Examples of polysorbates include Polysorbate 60 (polyoxyethylene (20) sorbitan monostearate, Tween 60) and Polysorbate 80 (polyoxyethylene (20) sorbitan monooleate, Tween 80). The type of polysorbate used or the combination of polysorbates used depends on the intended effect desired, as the different polysorbates offer different attributes due to molecular sizes. For example, the polysorbate molecules increase in size from polysorbate 20 to polysorbate 80. Using smaller size polysorbate molecules creates less vapor quantity, but permits deeper lung penetration. This may be desirable when the user is in public where he would not want to create a large plume of "smoke" (i.e. vapors). Conversely, if a dense vapor is desired, which can convey the aromatic constituents of tobacco, larger polysorbate molecules can be employed. An additional benefit of using the polysorbate family of compounds is that the polysorbates lower the heat of vaporization of mixtures in which they are present.

In some embodiments, the aerosol forming material comprises one or more fatty acids. Fatty acids may include short-chain, long-chain, saturated, unsaturated, straight chain, or branched chain carboxylic acids. Fatty acids generally include $C_4$ to $C_{28}$ aliphatic carboxylic acids. Non-limiting examples of short- or long-chain fatty acids include butyric, propionic, valeric, oleic, linoleic, stearic, myristic, and palmitic acids.

In some embodiments, the aerosol forming material comprises one or more fatty acid esters. Examples of fatty acid esters include alkyl esters, monoglycerides, diglycerides, and triglycerides. Examples of monoglycerides include monolaurin and glycerol monostearate. Examples of triglycerides include triolein, tripalmitin, tristearate, glycerol tributyrate, and glycerol trihexanoate).

In some embodiments, the aerosol forming material comprises one or more waxes. Examples of waxes include carnauba, beeswax, candellila, which are known known to stabilize aerosol particles, improve palatability, or reduce throat irritation.

In some embodiments, the aerosol forming material comprises one or more terpenes. As used herein, the term "terpenes" refers to hydrocarbon compounds produced by plants biosynthetically from isopentenyl pyrophosphate. Non-limiting examples of terpenes include limonene, pinene, farnesene, and cembrene.

In some embodiments, the aerosol forming material comprises one or more sugar alcohols. Examples of sugar alcohols include sorbitol, erythritol, mannitol, maltitol, isomalt, and xylitol. Sugar alcohols may also serve as flavor enhancers to certain flavor compounds, e.g. menthol and other volatiles, and generally improve on mouthfeel, tactile sensation, throat impact, and other sensory properties, of the resulting aerosol.

The amount of aerosol forming material that is incorporated (loaded) within the substrate is such that the aerosol generating component provides acceptable sensory and desirable performance characteristics. For example, it is highly preferred that sufficient amounts of aerosol forming material be employed in order to provide for the generation of a visible mainstream aerosol that in many regards resembles the appearance of tobacco smoke. The amount of forming materials within the aerosol generating component (e.g., the impregnated substrate) may be dependent upon factors such as the number of puffs desired per aerosol generating component.

In some embodiments, the substrate is impregnated with the aerosol forming material at a loading of at least about 10% by weight, of at least about 15% by weight, at least about 20% by weight, at least about 25% by weight, at least about 30% by weight, at least about 35% by weight, at least about 40% by weight, at least about 45% by weight, at least about 50% by weight, at least about 55% by weight, or at least about 60% by weight, based on a total weight of the impregnated substrate. Example ranges of total aerosol forming materials include about 15% to about 60% by weight, such as about 15% to about 55%, or about 15% to about 25%, based on the total weight of the impregnated substrate. Methods for loading aerosol forming materials onto substrate portions are described in U.S. Pat. No. 9,974,334 to Dooly et al., and U.S. Pub. Pat. App. Nos. 2015/0313283 to Collett et al. and 2018/0279673 to Sebastian et al., the disclosures of which are incorporated by reference herein in their entirety.

In any of the previous embodiments, the entire quantity of aerosol forming materials may be added prior to casting, extrusion, or the like, to form the aerosol generating component as disclosed herein. Alternatively, or in addition, a portion or all of the aerosol forming materials may be impregnated into the substrate post-formation (e.g., one or more aerosol forming materials may be sprayed or otherwise disposed in or on the substrate material to form the aerosol generating component as disclosed herein.

Active Ingredient

In certain embodiments, the substrate may be further impregnated with one or more active ingredients, added either as a component of the aerosol forming material, or added separately (e.g., during substrate preparation, or impregnated in the substrate after formation). The active ingredient can be any known agent adapted for therapeutic, prophylactic, or diagnostic use. These can include, for example, synthetic organic compounds, proteins and peptides, polysaccharides and other sugars, lipids, inorganic compounds, and nucleic acid sequences, having therapeutic, prophylactic, or diagnostic activity. Active ingredients include, but are not limited to, a nicotine component, botanical ingredients (e.g., lavender, peppermint, chamomile, basil, rosemary, ginger, cannabis, ginseng, maca, and tisanes), stimulants (e.g., caffeine and guarana), amino acids (e.g., taurine, theanine, phenylalanine, tyrosine, and tryptophan) and/or pharmaceutical, nutraceutical, and medicinal ingredients (e.g., vitamins, such as B6, B12, and C, and/or cannabinoids, such as tetrahydrocannabinol (THC) and cannabidiol (CBD)). The particular percentages and choice of ingredients will vary depending upon the desired flavor, texture, and other characteristics. Example active ingredients would include any ingredient known to impact one or more biological functions within the body, such as ingredients that furnish pharmacological activity or other direct effect in the diagnosis, cure, mitigation, treatment, or prevention of disease, or which affect the structure or any function of the body of humans or other animals (e.g., provide a stimulating action on the central nervous system, have an energizing effect, an antipyretic or analgesic action, or an otherwise useful effect on the body).

The quantity of active ingredient present may vary, and when present, is generally less than about 30%, or less than about 20% by weight of the impregnated substrate. For example, an active ingredient may be present in a quantity of from about 0.1%, about 0.5%, about 1%, or about 5%, to about 10%, about 20%, or about 30% by weight of the impregnated substrate.

In some embodiments, the active ingredient comprises one or more cannabinoids. In some embodiments, the cannabinoid comprises cannabidiol (CBD), tetrahydrocannabinol (THC), or a combination thereof.

In certain embodiments, the active ingredient comprises a nicotine component. By "nicotine component" is meant any suitable form of nicotine (e.g., free base or salt) for providing systemic absorption of at least a portion of the nicotine present. Typically, the nicotine component is selected from the group consisting of nicotine free base and a nicotine salt. In some embodiments, nicotine is in its free base form. Nicotine may be tobacco-derived (e.g., a tobacco extract) or non-tobacco derived (e.g., synthetic or otherwise obtained). In various embodiments, the impregnated substrate may comprise a nicotine component. In various embodiments, the impregnated substrate may not comprise a nicotine component. In some embodiments, the impregnated substrate may comprise a non-tobacco-derived nicotine component.

Typically, the nicotine component (calculated as the free base) when present, is in a concentration of at least about 0.001% by weight of the substrate, such as in a range from about 0.001% to about 10%. In some embodiments, the nicotine component is present in a concentration from about 0.1% w/w to about 10% by weight, such as, e.g., from about from about 0.1% w/w, about 0.2%, about 0.3%, about 0.4%, about 0.5% about 0.6%, about 0.7%, about 0.8%, or about 0.9%, to about 1%, about 2%, about 3%, about 4%, about 5%, about 6%, about 7%, about 8%, about 9%, or about 10% by weight, calculated as the free base and based on the total weight of the substrate. In some embodiments, the nicotine component is present in a concentration from about 0.1% w/w to about 3% by weight, such as, e.g., from about from about 0.1% w/w to about 2.5%, from about 0.1% to about 2.0%, from about 0.1% to about 1.5%, or from about 0.1% to about 1% by weight, calculated as the free base and based on the total weight of the substrate. These ranges can also apply to other active ingredients noted herein.

Flavorant

In some embodiments, the substrate comprises a flavorant. As used herein, reference to a "flavorant" refers to compounds or components that can be aerosolized and delivered to a user and which impart a sensory experience in terms of taste and/or aroma. Some examples of flavorants include, but are not limited to, vanillin, ethyl vanillin, cream, tea, coffee, fruit (e.g., apple, cherry, strawberry, peach and citrus flavors, including lime and lemon), maple, menthol, mint, peppermint, spearmint, wintergreen, nutmeg, clove, lavender, cardamom, ginger, honey, anise, sage, rosemary, hibiscus, rose hip, yerba mate, guayusa, honeybush, rooibos, yerba santa, bacopa monniera, gingko biloba, withania somnifera, cinnamon, sandalwood, jasmine, cascarilla, cocoa, licorice, and flavorings and flavor packages of the type and character traditionally used for the flavoring of cigarette, cigar, and pipe tobaccos. Syrups, such as high fructose corn syrup, also can be employed. Some examples of plant-derived compositions that may be suitable are disclosed in U.S. Pat. No. 9,107,453 and U.S. Pat. App. Pub. No. 2012/0152265 both to Dube et al., the disclosures of which are incorporated herein by reference in their entireties. The selection of such further components is variable based upon factors such as the sensory characteristics that are desired for the smoking article, their affinity for the substrate material, their solubility, and other physiochemical properties. The present disclosure is intended to encompass any such further components that are readily apparent to those skilled in the art of tobacco and tobacco-related or tobacco-derived products. See, e.g., Gutcho, Tobacco Flavoring Substances and Methods, Noyes Data Corp. (1972) and Leffingwell et al., Tobacco Flavoring for Smoking Products (1972), the disclosures of which are incorporated herein by reference in their entireties. It should be noted that reference to a flavorant should not be limited to any single flavorant as described above, and may, in fact, represent a combination of one or more flavorants. Additional flavorants, flavoring agents, additives, and other possible enhancing constituents are described in U.S. Pat. App. Pub. No. 2019/0082735 to Phillips et al., which is incorporated herein by reference in its entirety.

The quantity of flavorant present may vary, and when present, is generally less than about 30%, or less than about 20% by weight of the substrate. For example, a flavorant may be present in a quantity of from about 0.1%, about 0.5%, about 1%, or about 5%, to about 10%, about 20%, or about 30% by weight of the substrate.

Other Ingredients

In some embodiments, the substrate may further comprise a burn retardant material, conductive fibers or particles for heat conduction/induction, or any combination thereof. One example of a burn retardant material is ammonium phosphate. In some embodiments, other flame/burn retardant materials and additives may be included within the substrate, and may include organo-phosphorus compounds, borax, hydrated alumina, graphite, potassium, silica, tripolyphosphate, dipentaerythritol, pentaerythritol, and polyols. Other burn retardant materials, such as nitrogenous phosphonic acid salts, mono-ammonium phosphate, ammonium polyphosphate, ammonium bromide, ammonium borate, ethanolammonium borate, ammonium sulphamate, halogenated organic compounds, thiourea, and antimony oxides may also be used. In each aspect of flame-retardant, burn-retardant, and/or scorch-retardant materials used in the substrate material and/or other components (whether alone or in combination with each other and/or other materials), the desirable properties are independent of and resistant to undesirable off-gassing or melting-type behavior. Various manners and methods for incorporating tobacco into smoking articles, and particularly smoking articles that are designed so as to not purposefully burn virtually all of the tobacco within those smoking articles are set forth in U.S. Pat. No. 4,947,874 to Brooks et al.; U.S. Pat. No. 7,647,932 to Cantrell et al.; U.S. Pat. No. 8,079,371 to Robinson et al.; U.S. Pat. No. 7,290,549 to Banerjee et al.; and U.S. Pat. App. Pub. No. 2007/0215167 to Crooks et al.; the disclosures of which are incorporated herein by reference in their entireties.

As noted, the substrate may also include conductive fibers or particles for heat conduction or heating by induction. In some embodiments, the conductive fibers or particles may be arranged in a substantially linear and parallel pattern. In some embodiments, the conductive fibers or particles may have a substantially random arrangement. In some embodiments, the conductive fibers or particles may be constructed of or more of an aluminum material, a stainless steel material, a copper material, a carbon material, and a graphite material. In some embodiments, one or more conductive fibers or particles with different Curie temperatures may be included in the substrate material to facilitate heating by induction at varying temperatures.

Preparation and Form of Substrates

In some embodiments, the substrate is prepared using paper process technology, and the resulting sheet may be further reduced into cut rag or strips for inserting into the substrate-containing segment of an aerosol delivery device. The preparative method generally comprises the hot water extraction (60-90° C.) of tobacco leaves, stems, scraps, or dust for a period of time. This may be followed by separation (centrifugal and/or filter) into a weak extract containing solubles and a solids portion containing unrefined fibers. The weak extract may then be concentrated into a >20% solids (w/v) extract, by, for example, vacuum evaporation or other means. Optionally, one or more aerosol forming materials as disclosed herein may be added and thoroughly mixed to obtain a homogenous mix. To the tobacco solids may be added water and pre-pulped wood fibers, and the materials may again be refined to fibrillate the tobacco fibers. The refined tobacco pulp may then be put through a Fourdrinier screen to produce a non-woven web or paper. The web may then be dried to 45-55% moisture content. The concentrated extract containing the optional aerosol forming materials may then be added back to the web and dried down to 8-10% moisture. Optionally, an inert filtering aid may be added to the pulp before web formation on the Fourdrinier screen.

In other embodiments, cast sheet technology may be used to make a flat sheet. The cast sheet generally comprises a binder material, an inert filler, optionally one or more of the two or more aerosol formers, wood-derived fibers, and optionally a botanical, an active ingredient, and/or tobacco or a tobacco-derived material, each as described herein. For example, in some embodiments the fibrous material, one or more of the two or more aerosol forming materials as disclosed herein, and a binder may be blended together to form a slurry, which may be cast onto a surface (such as, for example, a moving belt). The cast slurry may then experience one or more drying and/or doctoring steps such that the result is a relatively consistent thickness cast sheet. Other examples of casting and paper-making techniques are set forth in U.S. Pat. No. 4,674,519 to Keritsis et al.; U.S. Pat. No. 4,941,484 to Clapp et al.; U.S. Pat. No. 4,987,906 to Young et al.; U.S. Pat. No. 4,972,854 to Kiernan et al.; U.S. Pat. No. 5,099,864 to Young et al.; U.S. Pat. No. 5,143,097 to Sohn et al.; U.S. Pat. No. 5,159,942 to Brinkley et al.; U.S. Pat. No. 5,322,076 to Brinkley et al.; U.S. Pat. No. 5,339,838 to Young et al.; U.S. Pat. No. 5,377,698 to Litzinger et al.; U.S. Pat. No. 5,501,237 to Young; and U.S. Pat. No. 6,216,706 to Kumar; the disclosures of which is incorporated herein by reference in their entireties. In some embodiments, the flat sheet may further be reduced into cut rag or strips for inserting into the substrate-containing segment of an aerosol delivery device. The cast sheet may also be gathered or rolled into rod for insertion into the substrate-containing segment of an aerosol delivery device.

In various embodiments, loading of the substrate with the aerosol forming material may be achieved by impregnating the substrate with the aerosol forming material during preparation of the substrate material, after formation of the substrate material, or both. For example, in some embodiments, a portion of the aerosol forming material (e.g., glycerol or propylene glycol) is added to the slurry used to form the substrate during e.g., making of a sheet, and a second portion of the aerosol forming material (e.g., glycerol or propylene glycol) is added to the sheet as a top dressing (for example, by spraying) to form the impregnated substrate (i.e., the aerosol generating component). In other embodiments, the entirety of the aerosol forming material is added to the slurry used to form the substrate during the making of the substrate. In some embodiments, further aerosol forming materials may be impregnated in the substrate, either to the substrate forming slurry, or as a top dressing. As one of skill will recognize, multiple permutations of methods for loading the substrate with the aerosol forming material is possible, depending on the specific substrate material, form, and the like. Accordingly, any such modifications are contemplated herein.

The form of the substrate may vary. In some embodiments, the substrate is in particulate form, shredded form, film form, paper process sheet form, cast sheet form, bead form, granular rod form, or extrudate form. In various embodiments, the form of the substrate may include gels, shreds, films, suspensions, extrusions, shavings, capsules, and/or particles (including pellets, beads, strips, or any desired particle shape of varying sizes) and combinations thereof. In some embodiments, the substrate is formed into a substantially cylindrical shape. In some embodiments, the substrate can have an extruded form. In some embodiments, the extrudate has a grooved surface, a central orifice, or both. In some embodiments, the extrudate is substantially similar in form to the heat source embodiments 204, described below with reference to FIG. 5 and FIG. 6.

As described herein, in another aspect is provided an aerosol delivery device comprising the aerosol generating component as disclosed herein; a heat source configured to heat the aerosol forming materials impregnated in the substrate portion to form an aerosol; and an aerosol pathway extending from the aerosol generating component to a mouth-end of the aerosol delivery device.

Although in some embodiments an aerosol generating component and a control body may be provided together as a complete smoking article or pharmaceutical delivery article generally, the components may be provided separately. For example, the present disclosure also encompasses a disposable unit for use with a reusable smoking article or a reusable pharmaceutical delivery article. In specific embodiments, such a disposable unit (which may be an aerosol generating component as illustrated in the appended figures) can comprise a substantially tubular shaped body having a heated end configured to engage the reusable smoking article or pharmaceutical delivery article, an opposing mouth end configured to allow passage of an inhalable substance to a consumer, and a wall with an outer surface and an inner surface that defines an interior space. Various embodiments of an aerosol generating component (or cartridge) are described in U.S. Pat. No. 9,078,473 to Worm et al., which is incorporated herein by reference in its entirety.

Although some figures described herein illustrate the control body and aerosol generating component in a working relationship, it is understood that the control body and the aerosol generating component may exist as individual devices. Accordingly, any discussion otherwise provided herein in relation to the components in combination also should be understood as applying to the control body and the aerosol generating component as individual and separate components.

In another aspect, the present disclosure may be directed to kits that provide a variety of components as described herein. For example, a kit may comprise a control body with one or more aerosol generating components. A kit may further comprise a control body with one or more charging components. A kit may further comprise a control body with one or more batteries. A kit may further comprise a control body with one or more aerosol generating components and one or more charging components and/or one or more batteries. In further embodiments, a kit may comprise a plurality of aerosol generating components. A kit may further comprise a plurality of aerosol generating components and one or more batteries and/or one or more charging components. In the above embodiments, the aerosol generating components or the control bodies may be provided with a heating member inclusive thereto. The inventive kits may further include a case (or other packaging, carrying, or storage component) that accommodates one or more of the further kit components. The case could be a reusable hard or soft container. Further, the case could be simply a box or other packaging structure.

FIG. 5 illustrates a perspective view of an aerosol generating component, according to another example embodiment of the present disclosure, and FIG. 6 illustrates a perspective view of the aerosol generating component of FIG. 5 with an outer wrap removed. In particular, FIG. 5 illustrates an aerosol generating component 200 that includes an outer wrap 202, and FIG. 6 illustrates the aerosol generating component 200 wherein the outer wrap 202 is removed to reveal the other components of the aerosol generating component 200. In the depicted embodiment, the aerosol generating component 200 of the depicted embodiment includes a heat source 204, a substrate portion 210, an intermediate component 208, and a filter 212. In the depicted embodiment, the intermediate component 208 and the filter 212 together comprise a mouthpiece 214.

Although an aerosol deliver device and/or an aerosol generating component according to the present disclosure may take on a variety of embodiments, as discussed in detail below, the use of the aerosol delivery device and/or aerosol generating component by a consumer will be similar in scope. The foregoing description of use of the aerosol delivery device and/or aerosol generating component is applicable to the various embodiments described through minor modifications, which are apparent to the person of skill in the art in light of the further disclosure provided herein. The description of use, however, is not intended to limit the use of the articles of the present disclosure but is provided to comply with all necessary requirements of disclosure herein.

In various embodiments, the heat source 204 may be configured to generate heat upon ignition thereof. In the depicted embodiment, the heat source 204 comprises a combustible fuel element that has a generally cylindrical shape and that incorporates a combustible carbonaceous material. In other embodiments, the heat source 204 may have a different shape, for example, a prism shape having a triangular, cubic or hexagonal cross-section. Carbonaceous materials generally have a high carbon content. Preferred carbonaceous materials may be composed predominately of carbon, and/or typically may have carbon contents of greater than about 60 percent, generally greater than about 70 percent, often greater than about 80 percent, and frequently greater than about 90 percent, on a dry weight basis.

In some instances, the heat source 204 may incorporate elements other than combustible carbonaceous materials (e.g., tobacco components, such as powdered tobaccos or tobacco extracts; flavoring agents; salts, such as sodium chloride, potassium chloride and sodium carbonate; heat stable graphite fibers; iron oxide powder; glass filaments; powdered calcium carbonate; alumina granules; ammonia sources, such as ammonia salts; binding agents, such as guar gum, ammonium alginate and sodium alginate; and/or phase change materials for lowering the temperature of the heat source, described herein above). Although specific dimensions of an applicable heat source may vary, in some embodiments, the heat source 204 may have a length in an inclusive range of approximately 7 mm to approximately 20 mm, and in some embodiments may be approximately 17 mm, and an overall diameter in an inclusive range of approximately 3 mm to approximately 8 mm, and in some embodiments may be approximately 4.8 mm (and in some embodiments, approximately 7 mm). Although in other embodiments, the heat source may be constructed in a variety of ways, in the depicted embodiment, the heat source 204 is extruded or compounded using a ground or powdered carbonaceous material, and has a density that is greater than about 0.5 g/cm$^3$, often greater than about 0.7 g/cm$^3$, and frequently greater than about 1 g/cm$^3$, on a dry weight basis. See, for example, the types of fuel source components, formulations and designs set forth in U.S. Pat. No. 5,551,451 to Riggs et al. and U.S. Pat. No. 7,836,897 to Borschke et al., which are incorporated herein by reference in their entireties. Although in various embodiments, the heat source may have a variety of forms, including, for example, a substantially solid cylindrical shape or a hollow cylindrical (e.g., tube) shape, the heat source 204 of the depicted embodiment comprises an extruded monolithic carbonaceous material that has a generally cylindrical shape but with a plurality of grooves 216 extending longitudinally from a first end of the extruded monolithic carbonaceous material to an opposing second end of the extruded monolithic carbonaceous material. In some embodiments, the aerosol delivery device, and in particular, the heat source, may include a heat transfer component. In various embodiments, a heat transfer component may be proximate the heat source, and, in some embodiments, a heat transfer component may be located in or within the heat source. Some examples of heat transfer components are described in in U.S. Pat. App. Pub. No. 2019/0281891 to Hejazi et al., which is incorporated herein by reference in its entirety.

Although in the depicted embodiment, the grooves 216 of the heat source 204 are substantially equal in width and depth and are substantially equally distributed about a circumference of the heat source 204, other embodiments may include as few as two grooves, and still other embodiments may include as few as a single groove. Still other embodiments may include no grooves at all. Additional embodiments may include multiple grooves that may be of unequal width and/or depth, and which may be unequally spaced around a circumference of the heat source. In still other embodiments, the heat source may include flutes and/or slits extending longitudinally from a first end of the extruded monolithic carbonaceous material to an opposing second end thereof. In some embodiments, the heat source may comprise a foamed carbon monolith formed in a foam process of the type disclosed in U.S. Pat. No. 7,615,184 to Lobovsky, which is incorporated herein by reference in its entirety. As such, some embodiments may provide advantages with regard to reduced time taken to ignite the heat source. In some other embodiments, the heat source may be co-extruded with a layer of insulation (not shown), thereby reducing manufacturing time and expense. Other embodiments of fuel elements include carbon fibers of the type described in U.S. Pat. No. 4,922,901 to Brooks et al. or other heat source embodiments such as is disclosed in U.S. Pat. App. Pub. No. 2009/0044818 to Takeuchi et al., each of which is incorporated herein by reference in its entirety.

Generally, the heat source is positioned sufficiently near an aerosol generating component (e.g., a substrate portion) having one or more aerosolizable components so that the aerosol formed/volatilized by the application of heat from the heat source to the aerosolizable components (as well as any flavorants, medicaments, and/or the like that are likewise provided for delivery to a user) is deliverable to the user by way of the mouthpiece. That is, when the heat source heats the substrate portion, an aerosol is formed, released, or generated in a physical form suitable for inhalation by a consumer. It should be noted that the foregoing terms are meant to be interchangeable such that reference to release, releasing, releases, or released includes form or generate, forming or generating, forms or generates, and formed or generated. Specifically, an inhalable substance is released in the form of a vapor or aerosol or mixture thereof.

Referring back to FIGS. 5 and 6, the outer wrap 202 may be provided to engage or otherwise join together at least a portion of the heat source 204 with the substrate portion 210 and at least a portion of the mouthpiece 214. In various embodiments, the outer wrap 202 is configured to be retained in a wrapped position in any manner of ways including via an adhesive, or a fastener, and the like, to allow the outer wrap 202 to remain in the wrapped position. Otherwise, in some other aspects, the outer wrap 202 may be configured to be removable as desired. For example, upon retaining the outer wrap 202 in a wrapped position, the outer wrap 202 may be able to be removed from the heat source 204, the substrate portion 210, and/or the mouthpiece 214.

In some embodiments, in addition to the outer wrap 202, the aerosol delivery device may also include a liner that is configured to circumscribe the substrate portion 210 and at least a portion of the heat source 204. Although in other embodiments the liner may circumscribe only a portion of the length of the substrate portion 210, in some embodiments, the liner may circumscribe substantially the full length of the substrate portion 210. In some embodiments, the outer wrap material 202 may include the liner. As such, in some embodiments the outer wrap material 202 and the liner may be separate materials that are provided together (e.g., bonded, fused, or otherwise joined together as a laminate). In other embodiments, the outer wrap 202 and the liner may be the same material. In any event, the liner may be configured to thermally regulate conduction of the heat generated by the ignited heat source 204, radially outward of the liner. As such, in some embodiments, the liner may be constructed of a metal foil material, an alloy material, a ceramic material, or other thermally conductive amorphous carbon-based material, and/or an aluminum material, and in some embodiments may comprise a laminate. In some embodiments, depending on the material of the outer wrap 202 and/or the liner, a thin layer of insulation may be provided radially outward of the liner. Thus, the liner may advantageously provide, in some aspects, a manner of engaging two or more separate components of the aerosol generating component 200 (such as, for example, the heat source 204, the substrate portion 210, and/or a portion of the mouthpiece 214), while also providing a manner of facilitating heat transfer axially therealong, but restricting radially outward heat conduction.

As shown in FIG. 5, the outer wrap 202 (and, as necessary, the liner, and the substrate portion 210) may also include one or more openings formed therethrough that allow the entry of air upon a draw on the mouthpiece 214. In various embodiments, the size and number of these openings may vary based on particular design requirements. In the depicted embodiment, a plurality of openings 220 are located proximate an end of the substrate portion 210 closest to the heat source 204, and a plurality of separate cooling openings 221 are formed in the outer wrap 202 (and, in some embodiments, the liner) in an area proximate the filter 212 of the mouthpiece 214. Although other embodiments may differ, in the depicted embodiment, the openings 220 comprise a plurality of openings substantially evenly spaced about the outer surface of the aerosol generating component 200, and the openings 221 also comprise a plurality of openings substantially evenly spaced around the outer surface of the aerosol generating component 200. Although in various embodiments the plurality of openings may be formed through the outer wrap 202 (and, in some embodiments, the liner) in a variety of ways, in the depicted embodiment, the plurality of openings 220 and the plurality of separate cooling openings 221 are formed via laser perforation.

Referring back to FIG. 6, the aerosol generating component 200 of the depicted implementation also includes an intermediate component 208 and at least one filter 212. It should be noted that in various implementations, the intermediate component 208 or the filter 212, individually or together, may be considered a mouthpiece 214 of the aerosol generating component 200. Although in various implementations, neither the intermediate component nor the filter need be included, in the depicted implementation the intermediate component 208 comprises a substantially rigid member that is substantially inflexible along its longitudinal axis. In the depicted implementation, the intermediate component 208 comprises a hollow tube structure, and is included to add structural integrity to the aerosol generating component 200 and provide for cooling the produced aerosol. In some implementations, the intermediate component 208 may be used as a container for collecting the aerosol. In various implementations, such a component may be constructed from any of a variety of materials and may include one or more adhesives. Example materials include, but are not limited to, paper, paper layers, paperboard, plastic, cardboard, and/or composite materials. In the depicted implementation, the intermediate component 208 comprises a hollow cylindrical element constructed of a paper or plastic material (such as, for example, ethyl vinyl acetate (EVA), or other polymeric materials such as poly ethylene, polyester, silicone, etc. or ceramics (e.g., silicon carbide, alumina, etc.), or other acetate fibers), and the filter comprises a packed rod or cylindrical disc constructed of a gas permeable material (such as, for example, cellulose acetate or fibers such as paper or rayon, or polyester fibers).

As noted, in some implementations the mouthpiece 214 may comprise a filter 212 configured to receive the aerosol therethrough in response to the draw applied to the mouthpiece 214. In various implementations, the filter 212 is provided, in some aspects, as a circular disc radially and/or longitudinally disposed proximate the second end of the intermediate component 208. In this manner, upon draw on the mouthpiece 214, the filter 212 receives the aerosol flowing through the intermediate component 208 of the aerosol generating component 200. In some implementations, the filter 212 may comprise discrete segments. For example, some implementations may include a segment providing filtering, a segment providing draw resistance, a hollow segment providing a space for the aerosol to cool, a segment providing increased structural integrity, other filter segments, and any one or any combination of the above. In some implementations, the filter 212 may additionally or alternatively contain strands of tobacco containing material, such as described in U.S. Pat. No. 5,025,814 to Raker et al., which is incorporated herein by reference in its entirety.

In various implementations the size and shape of the intermediate component 208 and/or the filter 212 may vary, for example the length of the intermediate component 208 may be in an inclusive range of approximately 10 mm to approximately 30 mm, the diameter of the intermediate component 208 may be in an inclusive range of approximately 3 mm to approximately 8 mm, the length of the filter 212 may be in an inclusive range of approximately 10 mm to approximately 20 mm, and the diameter of the filter 212 may be in an inclusive range of approximately 3 mm to approximately 8 mm. In the depicted implementation, the intermediate component 208 has a length of approximately 20 mm and a diameter of approximately 4.8 mm (and in some implementations, approximately 7 mm), and the filter 212 has a length of approximately 15 mm and a diameter of approximately 4.8 mm (or in some implementations, approximately 7 mm).

In various implementations, ignition of the heat source 204 results in aerosolization of the aerosol forming materials associated with the substrate portion 210. Preferably, the elements of the substrate portion 210 do not experience thermal decomposition (e.g., charring, scorching, or burning) to any significant degree, and the aerosolized components are entrained in the air that is drawn through the aerosol generating component 200, including the filter 212, and into the mouth of the user. In various implementations, the mouthpiece 214 (e.g., the intermediate component 208 and/or the filter 212) is configured to receive the generated aerosol therethrough in response to a draw applied to the mouthpiece 214 by a user. In some implementations, the mouthpiece 214 may be fixedly engaged to the substrate portion 210. For example, an adhesive, a bond, a weld, and the like may be suitable for fixedly engaging the mouthpiece 214 to the substrate portion 210. In one example, the mouthpiece 214 is ultrasonically welded and sealed to an end of the substrate portion 210.

Many modifications and other embodiments of the disclosure will come to mind to one skilled in the art to which this disclosure pertains having the benefit of the teachings presented in the foregoing descriptions and the associated drawings. Therefore, it is to be understood that the disclosure is not to be limited to the specific embodiments disclosed herein and that modifications and other embodiments are intended to be included within the scope of the appended claims. Although specific terms are employed herein, they are used in a generic and descriptive sense only and not for purposes of limitation.

EXAMPLES

Aspects of embodiments of the present disclosure are more fully illustrated by the following examples, which are set forth to illustrate certain aspects of the present invention and are not to be construed as limiting thereof.

Example 1. Sulfur Content of Pulp Materials

Samples of flax pulp and of wood pulp prepared by a conventional Kraft process ("production"), and a modified, low-sulfur bleaching process ("Mt. Holly"), were each analyzed for sulfur content by Inductively Coupled Plasma Optical Emission Spectrometric (ICP-OES) analysis.

Samples of 0.15-0.50 g of each material were accurately weighed directly into disposable polyethylene 125 mL digestion tubes. To each sample was added 10 mL of nitric acid. After about 5 minutes, ribbed polyethylene covers were placed on each digestion vessel, and the vessels were heated at 115° C. in a Hot Block apparatus for approximately 40 minutes. Vessels were removed from heat and allowed to cool. Hydrogen peroxide (5 mL of 30%) was added to each vessel, and the samples allowed to react at room temperature for approximately 5 minutes, then returned to heat in the Hot Block for approximately 30 minutes. The vessels were removed from the heat and allowed to cool. The contents of each vessel were transferred to 100 mL class A Teflon or glass volumetric flasks and diluted to volume with purified water. Samples were filtered through 0.45-micron filter units, and sample aliquots were transferred to 15 mL polyethylene or polystyrene tubes for analysis. Internal standards (1000 mg/L sulfur) were added either before dilution to volume or to a precisely measured aliquot at the time of analysis.

Samples were analyzed by ICP-OES following calibration of the instrument against four standards (5000 to 30000 μg/L of sulfur). Results for sulfur content of each, reported as μg of sulfur per gram of sample, are provided in Table 1. The results demonstrate that the flax pulp had the lowest residual sulfur content.

TABLE 1

Sulfur content of pulp materials.

| Sample | Sulfur (μg/g) |
|---|---|
| Production Kraft Wood Pulp | 649.6 |
| Mt. Holly Wood Pulp | 312.7 |
| Flax Pulp | 261.8 |

Example 2. Paper Process HNB Substrate (Comparative)

A comparative reconstituted tobacco heat-not burn (HNB) substrate was prepared using the paper process. Tobacco was mixed with ten times its weight of water and extracted in a counter extractor for 1 hour at 70° C. The extractor contents were subsequently separated by centrifugation into a weak extract liquor (3-6% w/v) and a non-soluble solids portion. The weak extract was then transferred into a vacuum evaporator and concentrated to 23% solids (w/v). Glycerol was added to the weak extract, and the mixture thoroughly mixed to obtain a final liquor mixture.

Pre-refined wood pulp was mixed with the non-soluble tobacco solids in a ratio of 2:1 by weight, and enough water was added to bring the final mixture to 5% solids content (w/v). The pulp mixture was refined using a disc refiner to obtain a fibrillated tobacco pulp. The pulp was conveyed to a head box and drained over a Fourdrinier wire machine to obtain a wet web (base sheet). The base sheet was dried to 40-55% moisture content. The final liquor mix was added back onto the wet web by spray application, and the base sheet dried to 8-10% (w/w) moisture content. The final sheet was then diced into leaflet pieces. The final percent composition by weight of the HNB substrate is provided in Table 2.

Example 3. Paper Process HNB Substrate (Inventive)

A reconstituted tobacco HNB substrate according to an embodiment of the disclosure was prepared similarly to Example 2, but substituting flax pulp for the wood pulp in Example 2. The final percent composition by weight of the HNB substrate is provided in Table 2.

Example 4. Paper Process HNB Substrate (Inventive)

A reconstituted tobacco HNB substrate according to an embodiment of the disclosure was prepared similarly to Example 3, but adding calcium carbonate to the tobacco pulp before web formation. The tobacco extract solids were not added back to the formed web; rather, a 50/50 mixture (% by weight) of glycerol and propylene glycol was mixed with caramel color and sprayed onto the formed web. The final percent composition by weight of the HNB substrate is provided in Table 2.

TABLE 2

Final sheet compositions for paper process HNB substrates

| | Example 2 (Comparative) | | Example 3 (Inventive) | | Example 4 (Inventive) | |
|---|---|---|---|---|---|---|
| Component | % by weight | Batch size (LB) | % by weight | Batch size (LB) | % by weight | Batch size (LB) |
| Calcium carbonate | 0 | | 0 | | 8.5 | 42.5 |
| Wood pulp | 30.0 | 150.0 | | | | |
| Flax pulp | | | 30.0 | 150.0 | 50.0 | 250.0 |
| Tobacco Fiber | 15 | 75.0 | 15.0 | 75.0 | 15.0 | 75.0 |
| Tobacco extract solids | 40.0 | 200.0 | 40.0 | 200.0 | 0 | |
| Glycerin | 15.0 | 75.0 | 15.0 | 75.0 | 10.0 | 50.0 |
| Propylene glycol | 0 | | 0 | | 10.0 | 50.0 |
| Brown flavoring (caramel) | 0 | | 0 | | 1.5 | 7.5 |
| Total | 100.0 | 500.0 | 100.0 | 500.0 | 100.0 | 500.0 |

Example 5. Cast Sheet Process HNB Substrate (Comparative)

A reconstituted tobacco HNB substrate was prepared using the cast sheet process. Sodium alginate was slowly added to water and hydrated in a high shear mixing tank for 30 minutes under vacuum. Pre-refined wood pulp fibers of zero freeness were then added to the hydrated alginate slurry and the combination mixed for 15 minutes at low shear speed.

In a separate mixing tank, calcium carbonate was slowly added to glycerol and tobacco extract powder, and the combination mixed gently for 30 min to form a slurry. The hydrated alginate mixture was then transferred into the calcium carbonate slurry tank, and the combination mixed for another 30 minutes under moderate mixing speeds under vacuum to obtain a final slurry. The final slurry was then cast onto a 22-inch-wide stainless-steel conveyer belt using a casting knife set at 1-3 mm gap opening. The cast material (film) was subsequently dried into a flat sheet by conveying the film through a 200-foot convectional tunnel dryer comprising multiple heated zones (temperature of 80-100° C.). The flat sheet was wound onto a bobbin and vacuum sealed in a polyethylene bag to prevent moisture pickup and blocking during shipment. The bobbin was subsequently unwound and the sheet cut into strips (25-20 cuts per square inch). The final percent composition by weight of the HNB substrate is provided in Table 3.

Example 6. Cast Sheet Process HNB Substrate (Inventive)

A reconstituted tobacco HNB substrate according to an embodiment of the disclosure was prepared similarly to Example 5, but substituting flax pulp for the wood pulp. The final percent composition by weight of the HNB substrate is provided in Table 3.

Example 7. Cast Sheet Process HNB Substrate (Inventive)

A reconstituted tobacco HNB substrate according to an embodiment of the disclosure was prepared similarly to Example 6, but substituting ammonium alginate for the sodium alginate, and substituting a 50/50 mixture (% by weight) of glycerol and propylene glycol for the glycerol.

TABLE 3

Final sheet compositions for cast sheet process HNB substrates (Examples 5-7).

| | Example 5 (Comparative) | | Example 6 (Inventive) | | Example 7 (Inventive) | |
|---|---|---|---|---|---|---|
| Component | % by weight | Batch size (LB) | % by weight | Batch size (LB) | % by weight | Batch size (LB) |
| Calcium carbonate | 47.0 | 235.0 | 47.0 | 189.0 | 45.0 | 135.0 |
| Sodium alginate | 8.0 | 40.0 | 8.0 | 30.0 | | |
| Ammonium alginate | 0 | | 0 | | 10.0 | 30.0 |
| Wood pulp | 10.0 | 50.0 | | | | |
| Flax pulp | | | 10.0 | 30.0 | 10.0 | 30.0 |
| Glycerin | 20.0 | 100.0 | 20.0 | 60.0 | 10.0 | 30.0 |
| Propylene glycol | 0 | | 0 | | 10.0 | 30.0 |
| Tobacco extract powder | 15.0 | 75.00 | 15.0 | 75.0 | 15.0 | 75.0 |
| Total | 100.0 | 500.0 | 100.0 | 300.0 | 100.0 | 300.0 |
| Water | | 1650.0 | | 900.0 | | 1000.0 |

Example 8. Cast Sheet Process HNB Substrate (Comparative)

A comparative reconstituted tobacco HNB substrate was prepared using the cast sheet process. Kraft wood pulp (15 g; 15% of final product by weight) and tobacco solids (15 g, 15% by weight of final product) were added to water (1200 g) in a blender and blended at medium speed for 5 minutes. With the blender running, sodium alginate of high and low molecular weight (25 g total weight; 25% by weight of final product; a 3:1 mixture by weight of Protanal® 6650 and Manucol® LD) were added, and the mixture blended at high speed for 3 minutes. Glycerol (15 g; 15% by weight of final product) was added, followed by an additional 2 minutes of blending. The mixture was allowed to settle for about 30 minutes. Tobacco extract (130 g; 30% by weight) was added and mixed for about 5 minutes, then settled for 15-30 minutes. The mixture was transferred to stainless steel plates and spread with a casting knife at 4 mm setting. The plates were dried at 77° C. for 30-60 minutes in a forced air oven to provide the recon substrate.

Example 9. Cast Sheet Process HNB Substrate (Inventive)

A reconstituted tobacco HNB substrate according to an embodiment of the disclosure was prepared using the cast sheet process of Example 8, but substituting Mt. Holly wood pulp for the Kraft wood pulp.

Example 10. Cast Sheet Process HNB Substrate (Inventive)

A reconstituted tobacco HNB substrate according to an embodiment of the disclosure was prepared using the cast sheet process of Example 8, but substituting flax pulp for the Kraft wood pulp.

What is claimed is:

1. An aerosol generating component comprising a substrate carrying one or more aerosol forming materials, the substrate comprising:

a cellulosic material substantially free of sulfur compounds, the cellulosic material selected from the group consisting of a cellulosic pulp and a regenerated cellulose, and wherein the cellulosic material contains from about 100 ppm to about 350 ppm of sulfur compounds, measured as elemental sulfur;

one or more of a tobacco pulp and an aqueous tobacco extract;

a filler selected from the group consisting of maltodextrin, dextrose, calcium carbonate, calcium phosphate, lactose, sugar alcohols, microcrystalline cellulose, and combinations thereof; and a binder selected from the group consisting of alginates, starches, gums, dextrans, carrageenan, povidone, pullulan, zein, and combinations thereof.

2. The aerosol generating component of claim 1, wherein the cellulosic material is a cellulosic pulp or regenerated cellulose comprising at least about 90% cellulose by weight.

3. The aerosol generating component of claim 1, wherein the binder is an alginate and the filler is calcium carbonate.

4. The aerosol generating component of claim 1, wherein the one or more aerosol forming materials are selected from the group consisting of water, polyhydric alcohols, polysorbates, sorbitan esters, fatty acids, fatty acid esters, waxes, cannabinoids, terpenes, sugar alcohols, and combinations thereof.

5. The aerosol generating component of claim 1, wherein the one or more aerosol forming materials are polyhydric alcohols.

6. The aerosol generating component of claim 5, wherein the polyhydric alcohols are selected from the group consisting of glycerol, propylene glycol, 1,3-propanediol, diethylene glycol, triethylene glycol, and combinations thereof.

7. The aerosol generating component of claim 1, wherein the substrate further carries a flavorant, an active ingredient, or a combination thereof.

8. The aerosol generating component of claim 7, wherein the active ingredient comprises a nicotine component.

9. The aerosol generating component of claim 1, wherein the substrate is impregnated with the one or more aerosol forming materials at a loading of from about 15 to about 55% by weight, based on a total weight of the impregnated substrate.

10. The aerosol generating component of claim 1, wherein the substrate is in particulate form, shredded form, film form, paper process sheet form, cast sheet form, bead form, granular rod form, or extrudate form.

11. The aerosol generating component of claim 10, wherein the substrate is formed into a substantially cylindrical shape.

12. An aerosol delivery device, comprising:

the aerosol generating component of claim 1;

a heat source configured to heat the substrate carrying the one or more aerosol forming materials to form an aerosol; and an aerosol pathway extending from the aerosol generating component to a mouth-end of the aerosol delivery device.

13. The aerosol delivery device of claim 12, wherein the heat source comprises either an electrically powered heating element or a combustible ignition source.

14. The aerosol delivery device of claim 12, wherein the heat source is a combustible ignition source comprising a carbon-based material.

15. The aerosol delivery device of claim 12, wherein the heat source is an electrically-powered heating element.

16. The aerosol delivery device of claim 15, further comprising a power source electronically connected to the heating element.

17. The aerosol delivery device of claim 16, further comprising a controller configured to control the power transmitted by the power source to the heating element.

* * * * *